US009790673B2

(12) United States Patent
Scott et al.

(10) Patent No.: US 9,790,673 B2
(45) Date of Patent: Oct. 17, 2017

(54) DRAIN STRAINER AND STOPPER

(71) Applicant: POLDER HOUSEWARES, INC., Oxford, CT (US)

(72) Inventors: George Calvin Scott, New Fairfield, CT (US); Roberto Pedros, Oxford, CT (US); Kerry Cooper, Pleasantville, NY (US)

(73) Assignee: Polder Housewares, Inc., Oxford, CT (US)

( * ) Notice: Subject to any disclaimer, the term of this patent is extended or adjusted under 35 U.S.C. 154(b) by 97 days.

(21) Appl. No.: 14/973,877

(22) Filed: Dec. 18, 2015

(65) Prior Publication Data

US 2016/0215485 A1 Jul. 28, 2016

Related U.S. Application Data

(63) Continuation-in-part of application No. PCT/US2015/018075, filed on Feb. 27, 2015.

(60) Provisional application No. 61/946,182, filed on Feb. 28, 2014.

(51) Int. Cl.
*A47K 1/14* (2006.01)
*E03C 1/262* (2006.01)

(52) U.S. Cl.
CPC ..... *E03C 1/262* (2013.01); *A47K 1/14* (2013.01)

(58) Field of Classification Search
CPC ..... E03C 1/262; A47K 1/14
USPC ..... 4/287, 286–295
See application file for complete search history.

(56) References Cited

U.S. PATENT DOCUMENTS

| | | | | |
|---|---|---|---|---|
| 2,643,394 | A * | 6/1953 | Wood | E03C 1/262 215/311 |
| 2,944,265 | A * | 7/1960 | Carmichael | A47K 1/14 138/90 |
| 5,915,847 | A | 6/1999 | Spears | |
| 6,067,669 | A | 5/2000 | Peterson et al. | |
| 6,418,568 | B1 | 7/2002 | Briggs et al. | |
| 6,427,255 | B1 | 8/2002 | Duncan | |
| 6,484,329 | B1 | 11/2002 | Duncan | |
| 7,678,271 | B2 | 3/2010 | Curtin | |
| 7,832,027 | B2 | 11/2010 | Escobar et al. | |
| 8,011,030 | B2 | 9/2011 | Li | |

(Continued)

FOREIGN PATENT DOCUMENTS

| | | |
|---|---|---|
| CN | 102535596 A | 7/2012 |
| WO | 2015/131082 A1 | 9/2015 |

OTHER PUBLICATIONS

International Search Report/Written Opinion dated May 29, 2015 in counterpart Intl. Patent Application No. PCT/US2015/018075.

(Continued)

*Primary Examiner* — Christine Skubinna
(74) *Attorney, Agent, or Firm* — Duane Morris LLP

(57) ABSTRACT

An apparatus includes a base defining an opening. A body is coupled to the base. The body defines a plurality of holes and includes a circumferential ring coupled to a first side of the body. The body further includes an outwardly extending flange sized and configured to be received within the circumferential ring. The body is configured to be positioned in an extended configuration and a collapsed configuration. The flange includes at least one outwardly extending circumferential rib that forms a fluid-tight seal with an inner surface of the circumferential ring in the collapsed configuration.

21 Claims, 23 Drawing Sheets

(56) References Cited

U.S. PATENT DOCUMENTS

| | | | | |
|---|---|---|---|---|
| 8,117,685 | B2 | 2/2012 | Escobar et al. | |
| 8,171,574 | B2 * | 5/2012 | Escobar | E03C 1/262 4/290 |
| 8,214,934 | B2 | 7/2012 | Sullivan | |
| 9,386,886 | B2 * | 7/2016 | Lee | A47J 47/20 |
| 2004/0073992 | A1 | 4/2004 | Saman et al. | |
| 2008/0149552 | A1 | 6/2008 | Murphy | |

OTHER PUBLICATIONS

"Collapsible Stopper & Strainer", Tovolo, ICI USA, LLC, 2013 Catalog, http://www.tovolo.com/product/collapsible-stopper-and-strainer-2/.

"Silicone Sink Strainer & Stopper", OXO Good Grips Silicone Sink Strainer and Stopper, Dec. 10, 2013, https://www.oxo.com/silicone-sink-strainer-with-stopper.

* cited by examiner

DRAIN STRAINER AND STOPPER

CROSS-REFERENCE TO RELATED APPLICATION

This application is a continuation-in-part of PCT Application PCT/US15/18075, filed Feb. 27, 2015, entitled "DRAIN STRAINER AND STOPPER," and which claimed priority to U.S. Provisional Patent Application Ser. No. 61/946,182, filed Feb. 28, 2014, entitled "SINK STRAINER AND STOPPER," each of which is incorporated by reference herein in its entirety.

FIELD OF DISCLOSURE

The disclosed apparatus and method are directed to home accessories. More particularly, the disclosed apparatus and method are directed to home accessories for preventing items by straining, and stopping fluid, into a drain.

SUMMARY

In various embodiments, a drain strainer and stopper is disclosed. The drain strainer and stopper includes a base defining an opening. A body is coupled to the base. The body defines a plurality of holes and includes a circumferential ring coupled to a first side of the body. The body further includes an outwardly extending flange sized and configured to be received within the circumferential ring. The body is configured to be positioned in an extended configuration and a collapsed configuration. The flange includes at least one outwardly extending circumferential rib that forms a fluid-tight seal with an inner surface of the circumferential ring in the collapsed configuration.

In various embodiments, a method of operating a strainer and stopper is disclosed. The method comprises placing an outer surface of a body of a strainer and stopper in contact with a surface of a sink such that the body of the drain strainer and stopper is at least partially aligned with a drain of the sink and transitioning the body of the strainer and stopper to one of a collapsed configuration and an extended configuration. In the collapsed configuration, at least one circumferential rib extending from a flange of the strainer and stopper forms a fluid tight seal with an inner surface of a circumferential ring coupled to a body of the strainer and stopper. In the extended configuration, fluid is able to pass through a plurality of holes defined by the body.

In various embodiments, a drain strainer and stopper is disclosed. The drain strainer and stopper includes a base defining an opening. The base is formed from a first material. A body is coupled to the base and formed from a second material. The body defines a plurality of holes and includes a circumferential ring coupled to a first side of the body. The body further includes an outwardly extending flange sized and configured to be received within the circumferential ring. The body is configured to be positioned in an extended configuration and a collapsed configuration. The flange includes at least one outwardly extending circumferential rib that forms a fluid-tight seal with an inner surface of the circumferential ring in the collapsed configuration. The body includes at least one area having a reduced thickness to facilitate transitioning from the first extended configuration to the second collapsed configuration.

DETAILED DESCRIPTION

This description of the exemplary embodiments is intended to be read in connection with the accompanying drawings, which are to be considered part of the entire written description.

The disclosed drain strainer and stopper ("strainer/stopper") advantageously is configured to strain fluid as it passes into a drain in a first configuration or orientation and to stop fluid from entering a drain in a second configuration or orientation. The strainer has a durable, compact design that provides the ability to provide the straining and stopping functions using pushing and pulling motions as described in greater detail below.

Figure 6:
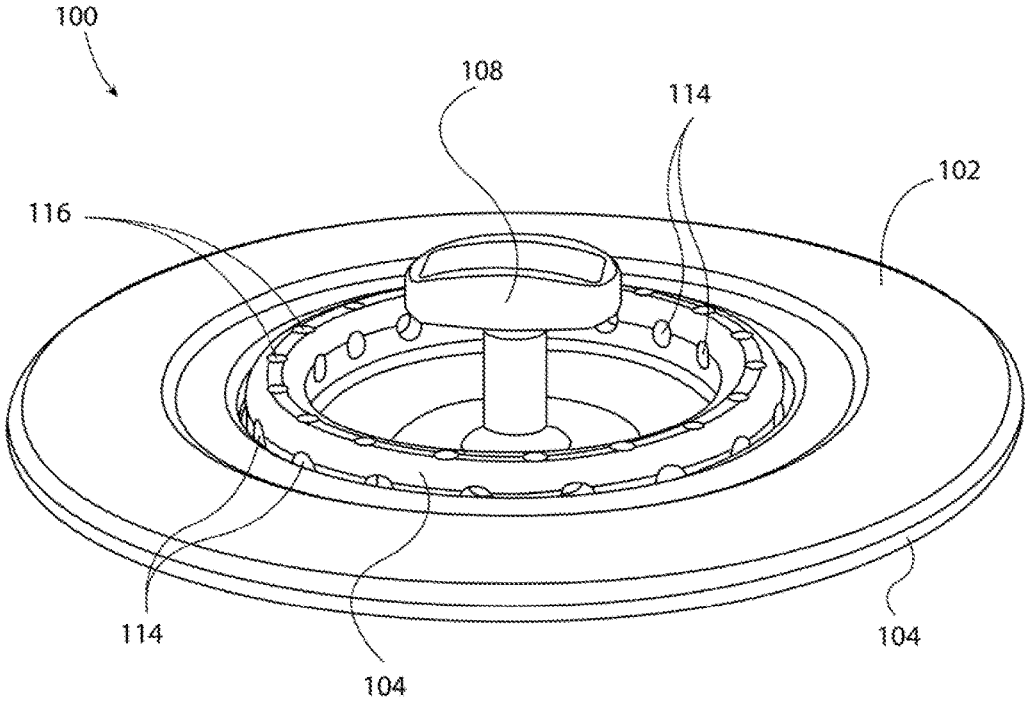
FIG. 6 is in isometric view of the drain strainer and stopper in a collapsed configuration in accordance with some embodiments.
Figure 7:
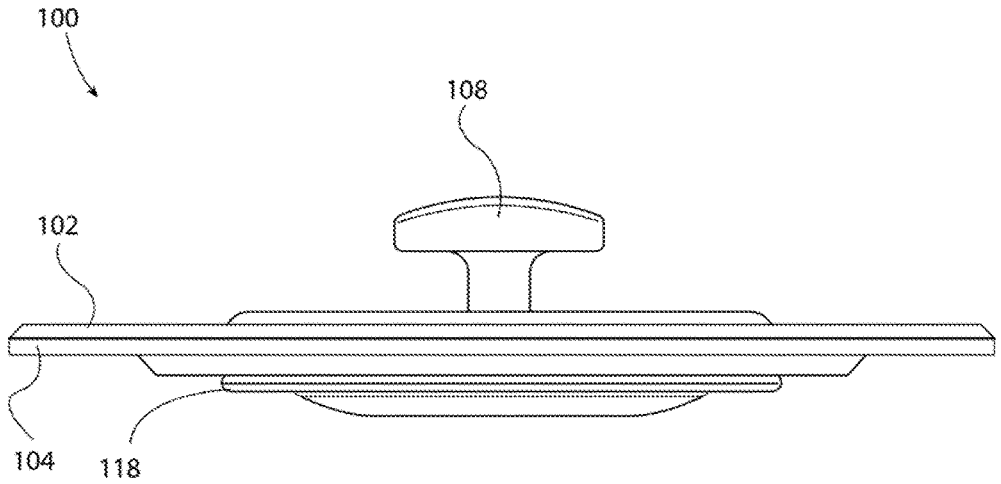
FIG. 7 is a side view of the drain strainer and stopper illustrated in FIG. 6 in accordance with some embodiments.
Figure 8:
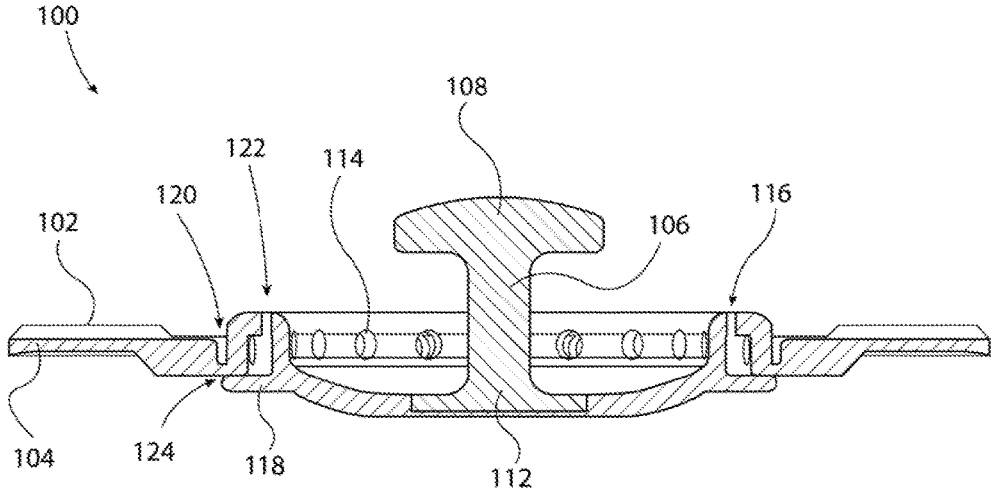
FIG. 8 is a cross-sectional view of the drain strainer and stopper illustrated in FIG. 6 in accordance with some embodiments.

FIGS. 1-5 illustrate one example of a strainer/stopper 100 in a first configuration, and FIGS. 6-8 illustrate strainer/stopper 100 in a second configuration in accordance with some embodiments. Referring first to FIGS. 1-5, strainer/stopper 100 includes a base 102 having a ring shape and a flexible body 104 coupled to and extending away from base 102. As used herein, the term "coupled to" includes direct coupling of the base 102 and the body 104, indirect coupling of the base 102 and the body 104, and/or a body 104 encapsulating a base 102. In some embodiments, base 102 is formed from a first material and body 104 is formed from a second material that is different from the first material. Examples of the first material include, but are not limited to, stainless steel, aluminum, polymers, and plastics, to list only a few possible materials. The second material is a flexible material such as, for example, silicone or a flexible plastic or polymer. In some embodiments, base 102 and body 104 are formed from the same material. Base 102 can have a size that corresponds to an industry standard kitchen or bathroom drain size; however, base 102 can have other dimensions as will be understood by one of ordinary skill in the art.

Figure 3:
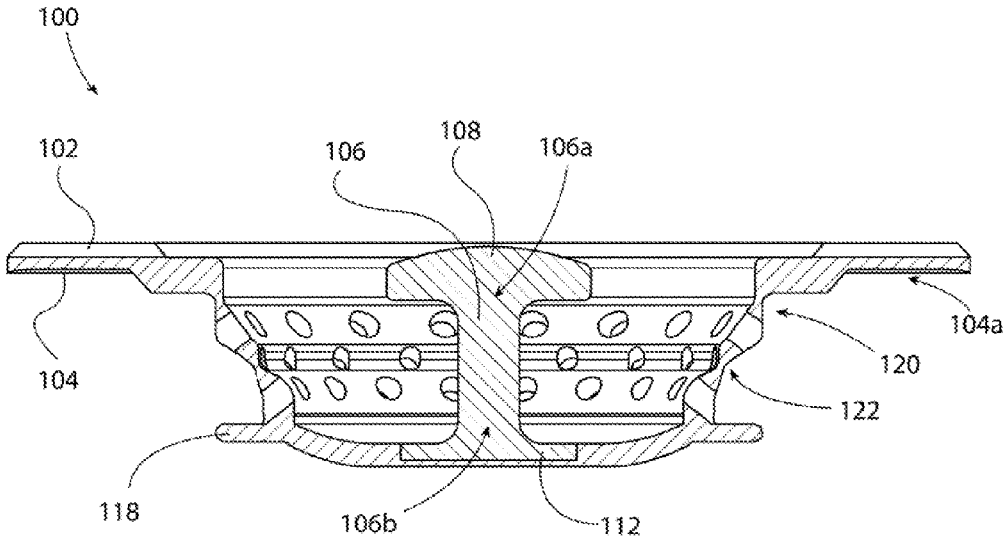
FIG. 3 is a cross-sectional view of the drain strainer and stopper illustrated in FIG. 1 in accordance with some embodiments.
Figure 4:
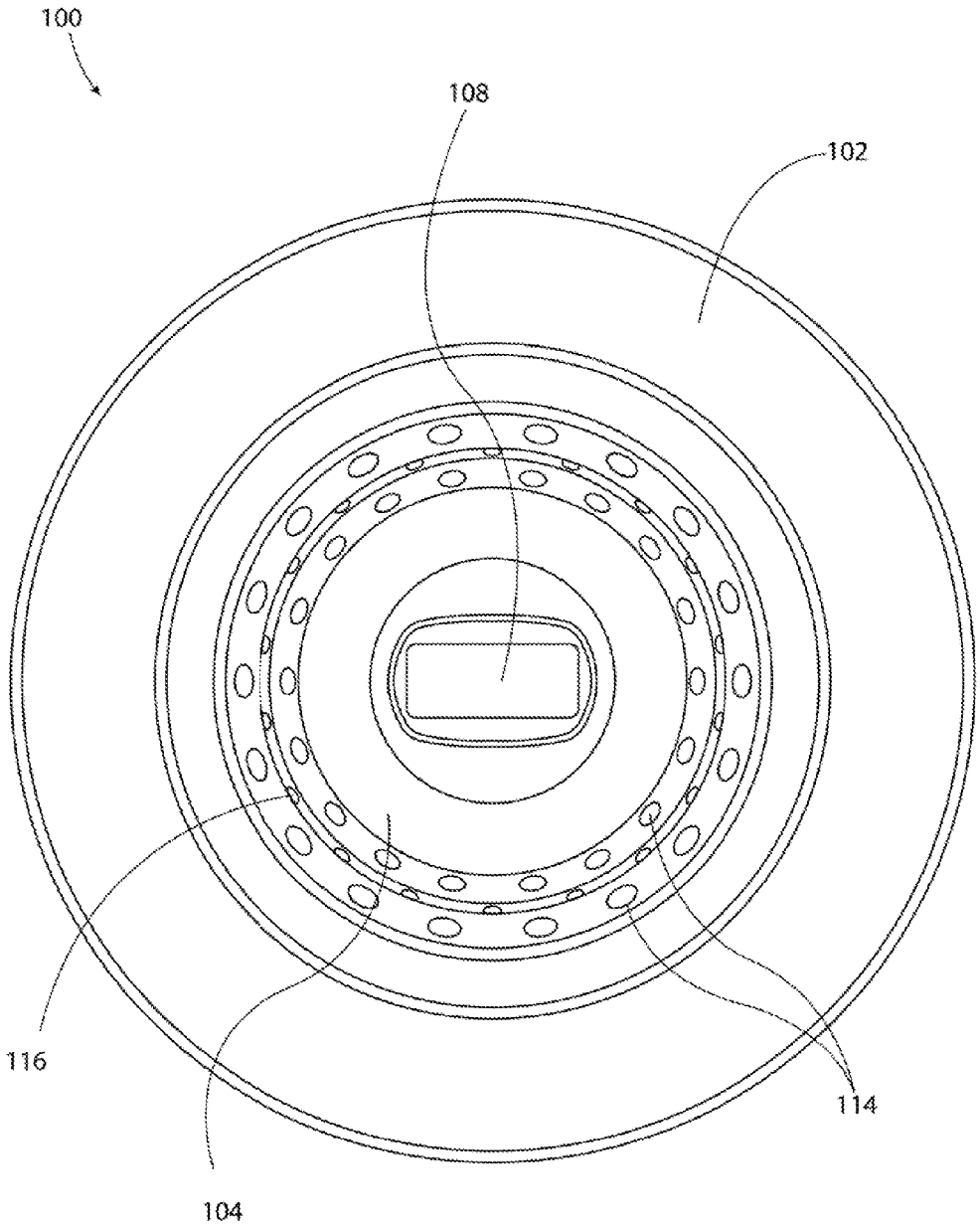
FIG. 4 is a top side view of the drain strainer and stopper illustrated in FIG. 1 in accordance with some embodiments.
Figure 5:
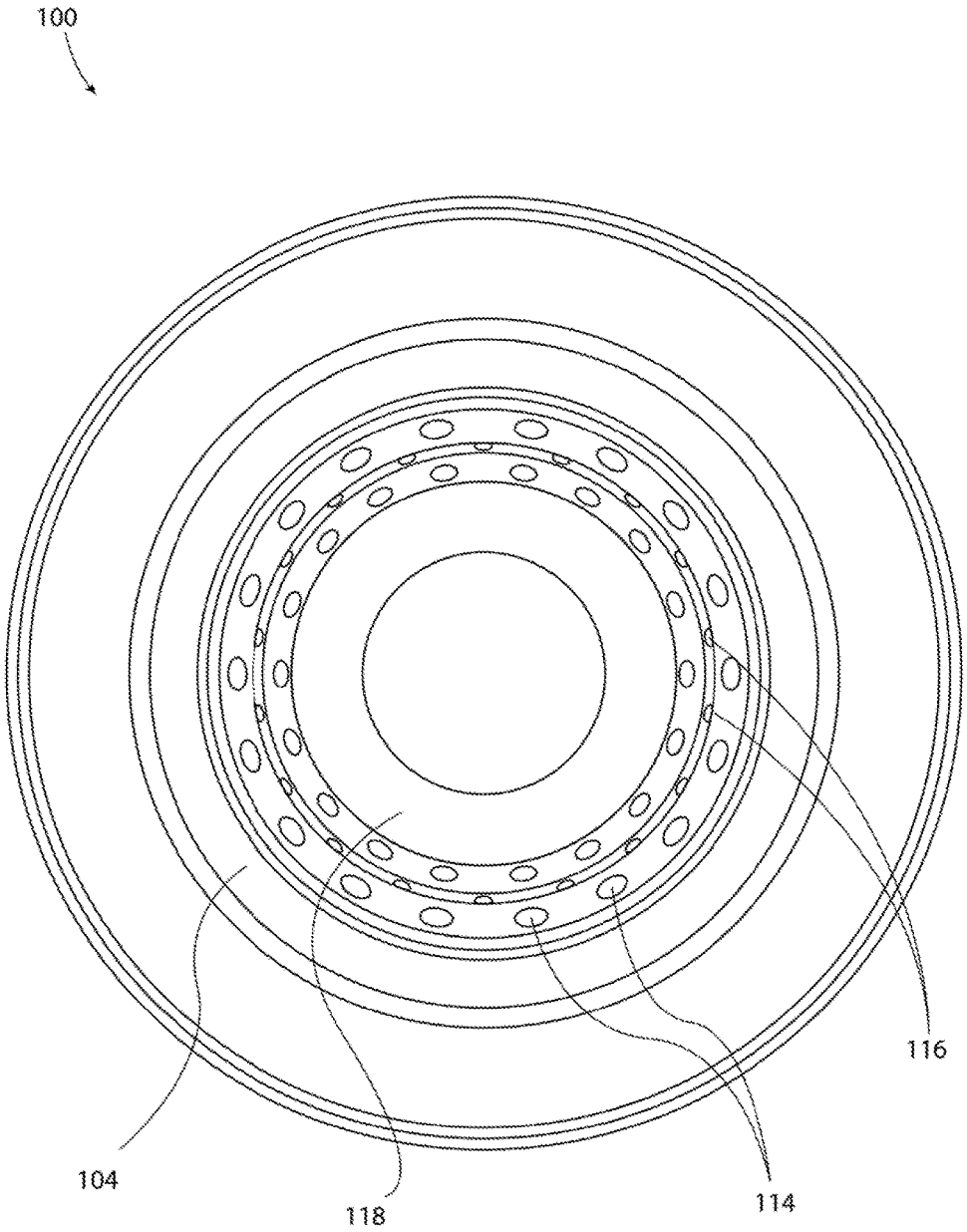
FIG. 5 is a bottom side view of the drain strainer and stopper illustrated in FIG. 1 in accordance with some embodiments.

A stem 106 having a knob 108 at its upper end 106*a* extends from a bottom inner surface 110 of body 104 as best seen in FIG. 3. In some embodiments, the lower end 106*b* of stem 106 includes a flange 112 that extends radially from stem 106. Stem 106, including knob 108 and flange 112, can be formed from a material that is the same as or different from the material from which body 104 is formed. In some embodiments, stem 106 is coupled to body 104 by overmolding body 104 onto stem 106; however, it will be apparent to one of ordinary skill in the art that stem 106 can be joined to body 104 through other manufacturing means or processes. In some embodiments, stem 106 is integrally formed with body 104. FIG. 1A shows an exploded view of base 102, body 104 configured to couple to a stem 106, and a separate stem 106 that can be coupled to body 104.

Figure 1:
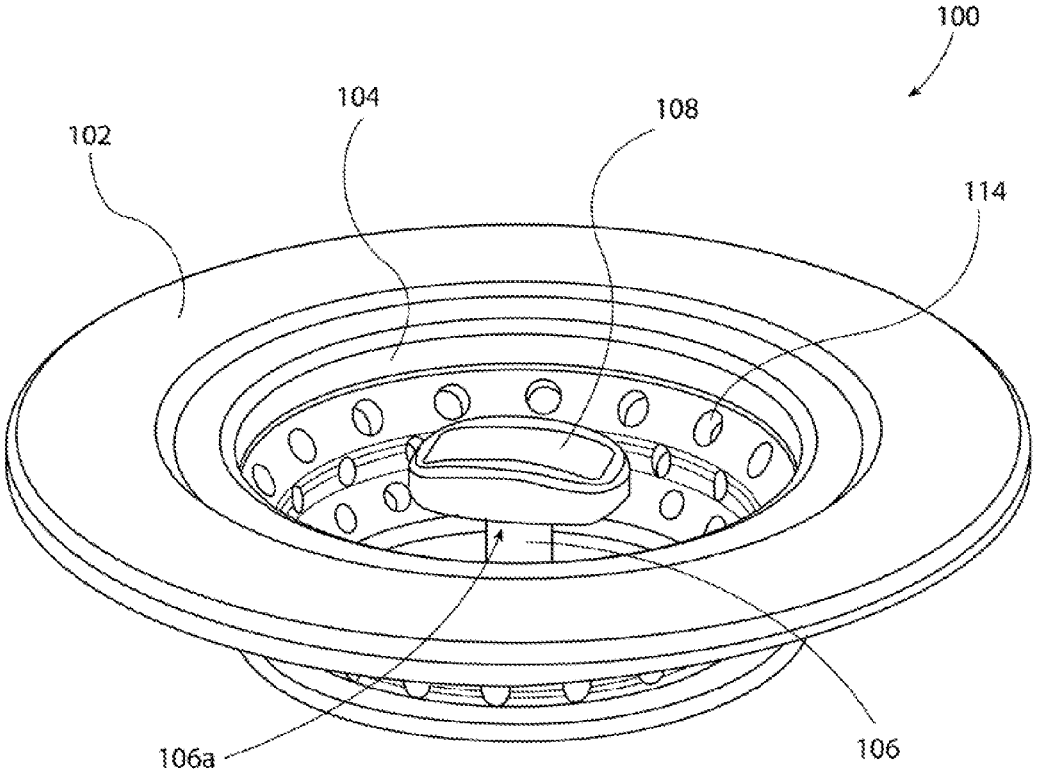
FIG. 1 is an isometric view of a drain strainer and stopper in an extended configuration in accordance with some embodiments.
Figure 1A:
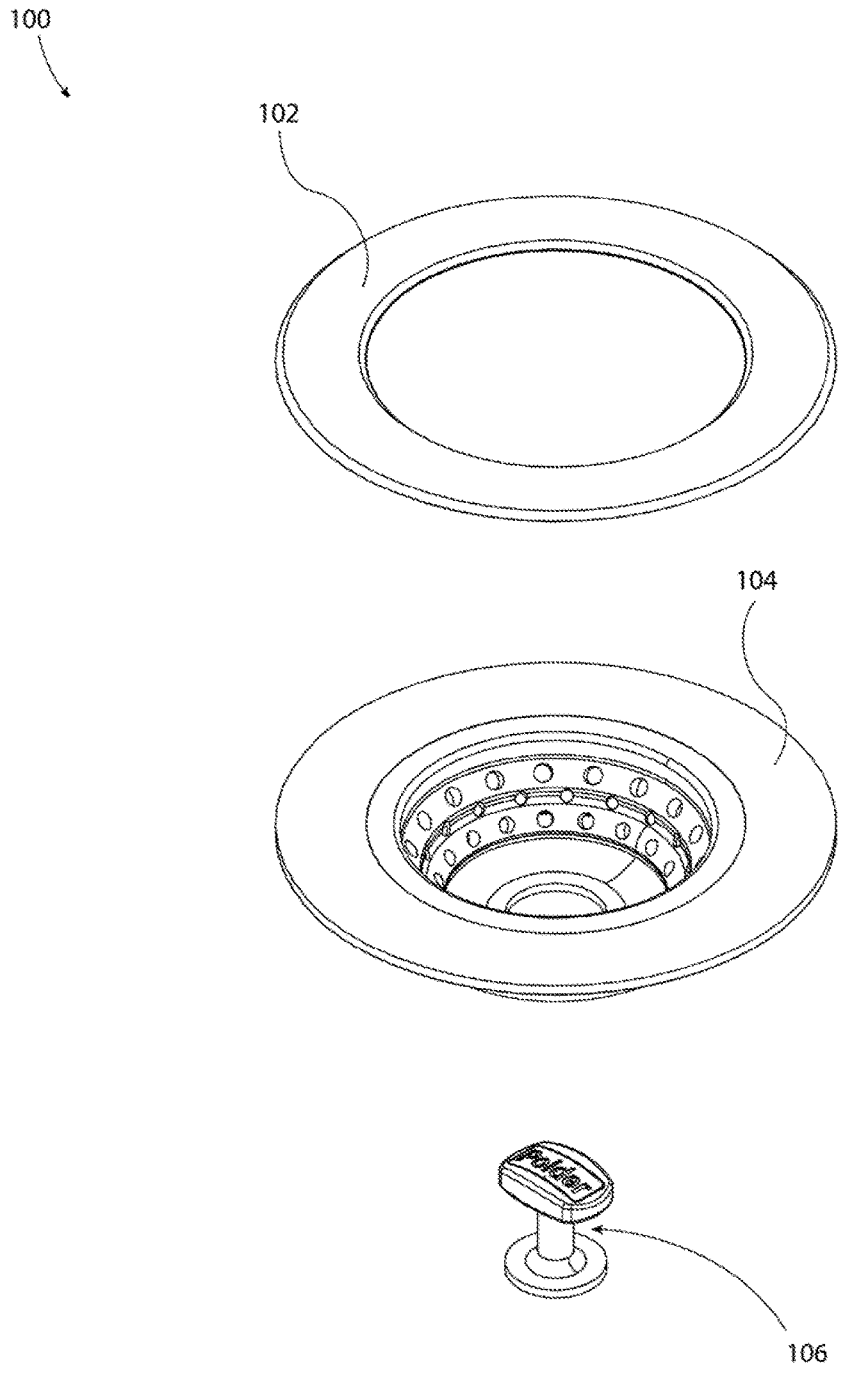
FIG. 1A is an exploded view of the components of the drain strainer and stopper in accordance with some embodiments.
Figure 2:
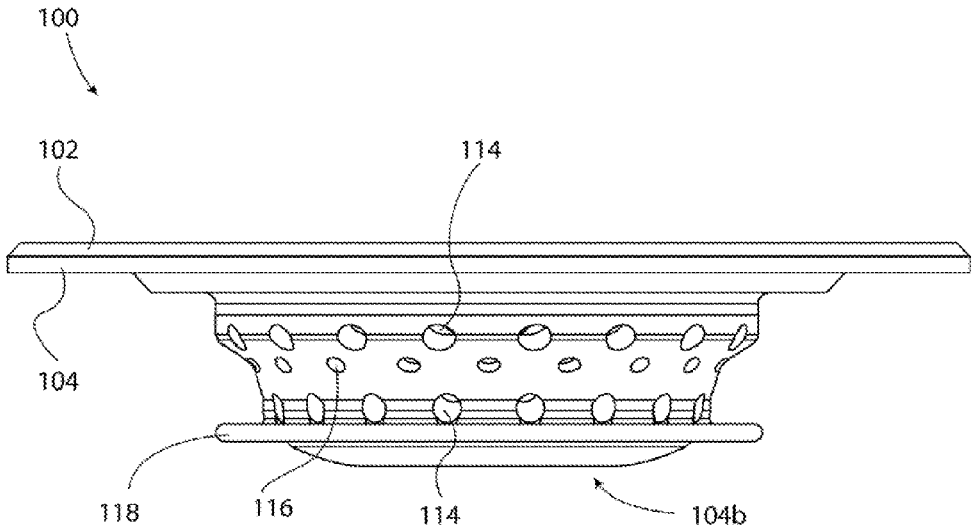
FIG. 2 is a side view of the drain strainer and stopper illustrated in FIG. 1 in accordance with some embodiments.

As best seen in FIGS. 1-3, body 104 defines a plurality of holes 114, 116 between its upper end 104*a* and outwardly extending flange 118, which is disposed adjacent lower end 104*b* (FIGS. 2 and 3). Holes 114, 116 can all be the same size or can be of different sizes. In the illustrated embodiment, holes 114, 116 are arranged in three circumferential rows with the top and bottom rows including holes 114 of the same size and the middle row having holes 116 of a slightly smaller size. As best seen in FIG. 3, body 104 includes two areas 120, 122 of reduced thickness. Areas 120, 122 are configured to facilitate the collapsing of body 104, i.e., the transition of body 104 from a first, extended configuration as shown in FIGS. 1-5 to a second, collapsed configuration as shown in FIGS. 6-8.

In the collapsed configuration of FIGS. 6-8, body 104 folds about circumferential axis that correspond to areas 120, 122 such that strainer/stopper 100 functions as a drain stopper in which fluid cannot pass from the upper side of the stopper 100 to the lower side of the stopper 100. As best seen in FIG. 8, when body 104 folds onto itself, the holes 114, 116 are positioned such that they are located above a seal 124 created between an upper surface of flange 118 and a portion of the lower surface of body 104. In some embodiments, the first and third rows of holes 114 align when the strainer/stopper 100 is in a collapsed position. The first row of holes is positioned about the area 120 and holes 116 are positioned around area 122. In some embodiments, the holes 114, 116 are configured to reduce the amount of force required to collapse body 104 onto itself. For example, in the illustrated embodiment, the second row of holes 116 reduces the force necessary to collapse the strainer/stopper 100. In some embodiments, the seal 124 is fluid tight.

The method of installing and using strainer/stopper 100 is now described with reference to FIGS. 1-8. Strainer/stopper 100 is positioned by placing strainer/stopper 100 such that body 104 extends into a drain opening. As noted above, base 102 is sized such that it is larger than the drain opening such that a lower surface of base 102 and or an outer surface of body 104 contacts the base of a sink (or drain) to form a fluid-tight seal.

In the extended configuration illustrated in FIGS. 1-5, water or other fluid is free to pass through holes 114, 116 and into the drain. Larger objects, i.e., objects larger than the openings of holes 114, 115, that could potentially block the drain are prevented from passing into the drain by strainer/stopper 100.

To convert the strainer/stopper 100 from a strainer to a stopper, the stem 106 is pulled upward away from the drain. In some embodiments, a user may grasp knob 108 when pulling stem upward. A downward force, i.e., a force in the direction of the sink, can also be applied to base 102 while the stem 106 is pulled upwardly. Areas 120, 122 facilitate body 104 folding onto itself, and flange 118 prevents body from being inverted. As noted above, a fluid-tight seal 124 is formed between an upper surface of flange 118 and a portion of the outer surface of body 104 at area 120.

In the collapsed configuration shown in FIGS. 6-8, water or other fluid cannot pass from the sink into the drain due to the seal between flange 118 and body 104. A seal is also provided between strainer/stopper 100 and the sink. In some embodiments, the seal is provided between an outer surface of body 104 at a location positioned between base 102. Strainer/stopper 104 can be converted back to its extended position by applying a downward force (i.e., a force in the direction of the sink drain) on stem 106 and/or knob 108, which causes body 104 to unfold such that it is disposed in a configuration as shown in FIGS. 1-5.

FIGS. 9-16 illustrate another example of a strainer/stopper 200 in accordance with some embodiments. Features of strainer/stopper 200 that are the same or similar to features of strainer/stopper 100 have the same reference numeral increased by 100. Common descriptions are not provided herein.

Figure 9:
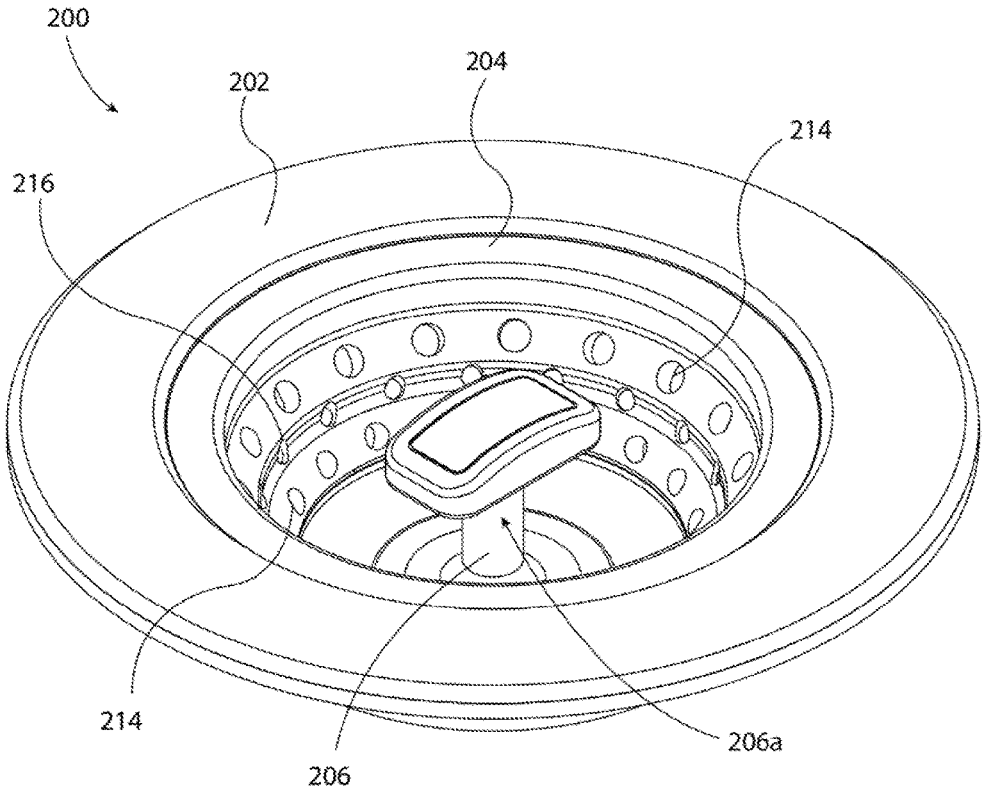
FIG. 9 is an isometric view of another example of a drain strainer and stopper in an extended configuration in accordance with some embodiments.
Figure 9A:
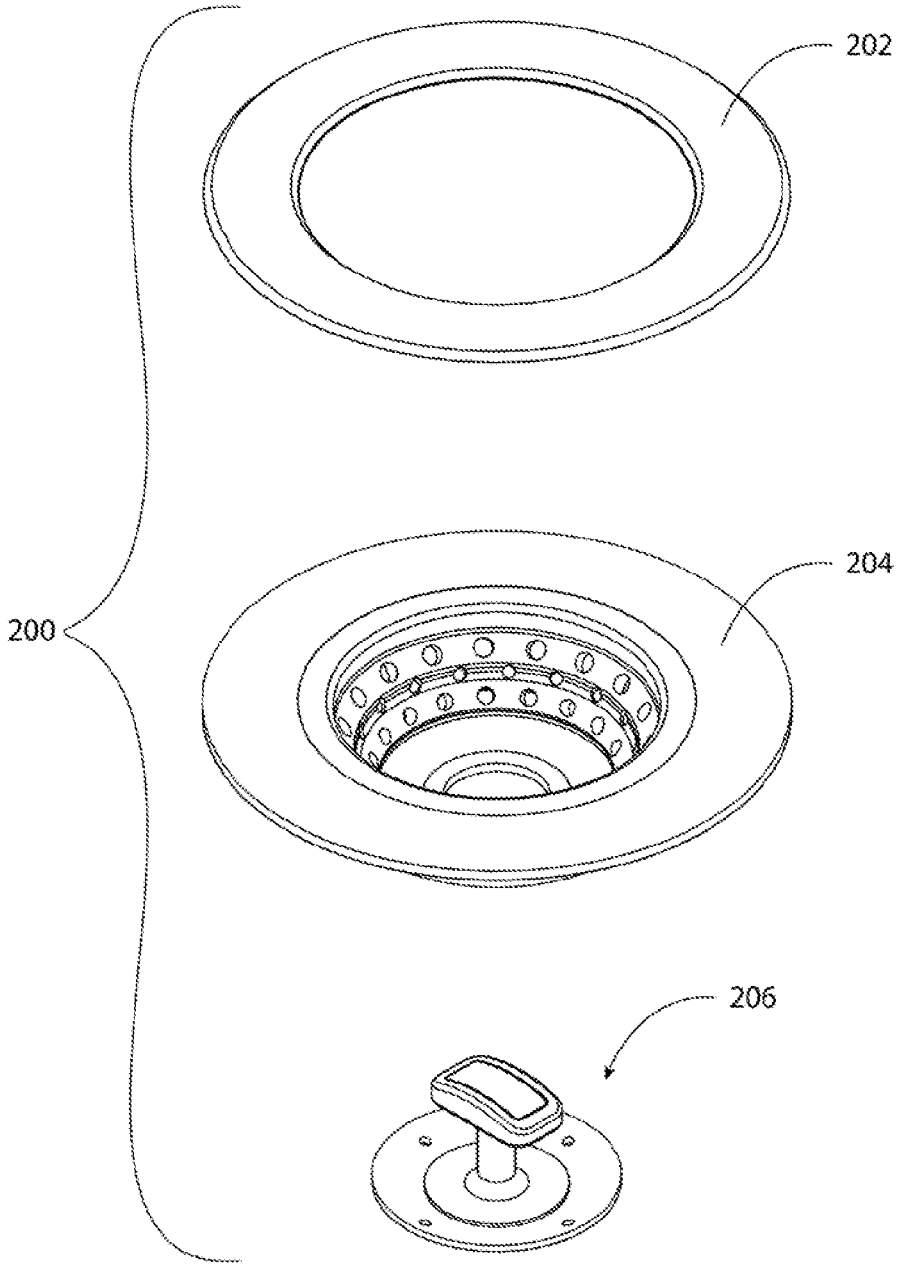
FIG. 9A is an exploded view of the components of the drain strainer and stopper illustrated in FIG. 9 in accordance with some embodiments.
Figure 10:
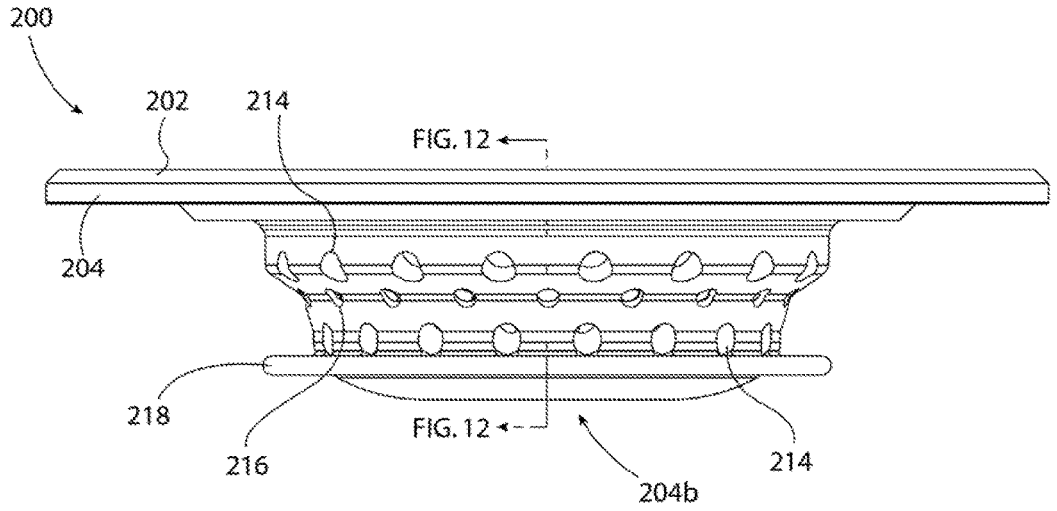
FIG. 10 is a front side view of the drain strainer and stopper illustrated in FIG. 9 in accordance with some embodiments.
Figure 11:
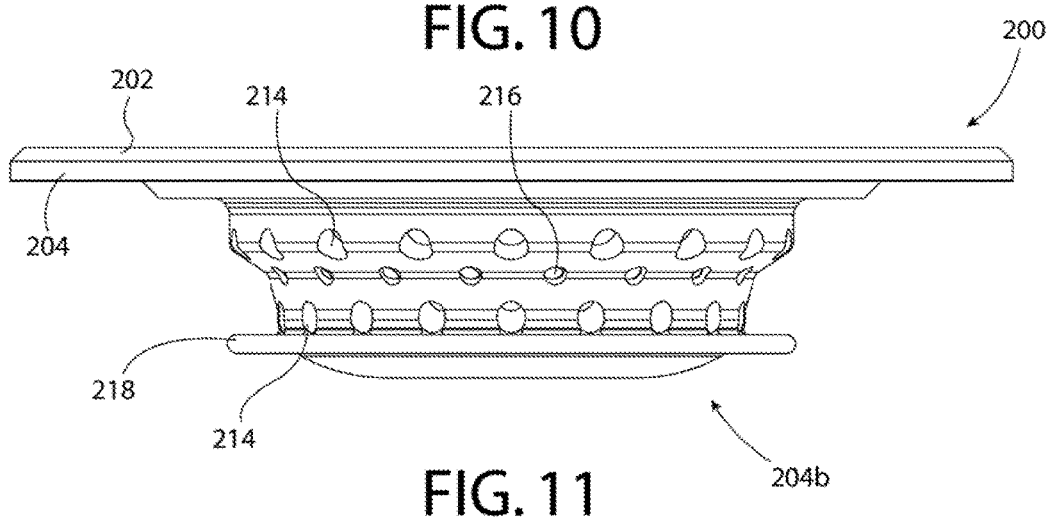
FIG. 11 is a side view of the drain strainer and stopper illustrated in FIG. 9 in accordance with some embodiments.
Figure 12:
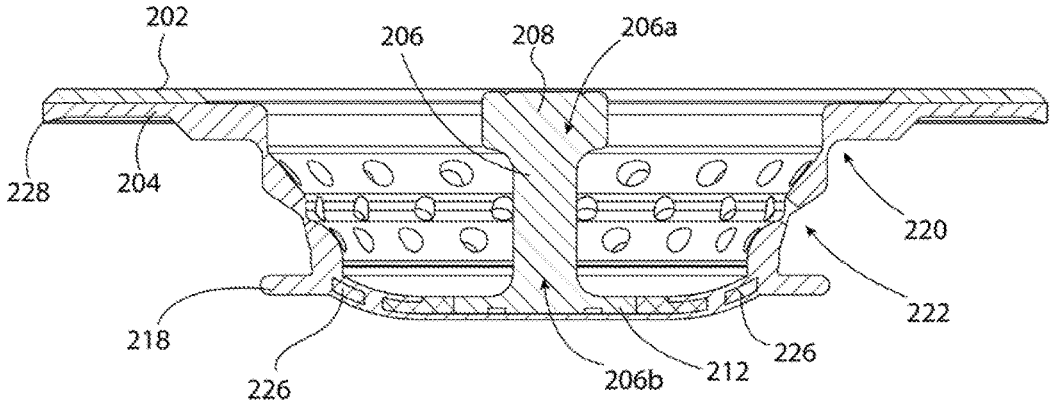
FIG. 12 is a cross-sectional view of the drain strainer and stopper illustrated taken along line FIG. 12-FIG. 12 in FIG. 9 in accordance with some embodiments.
Figure 13:
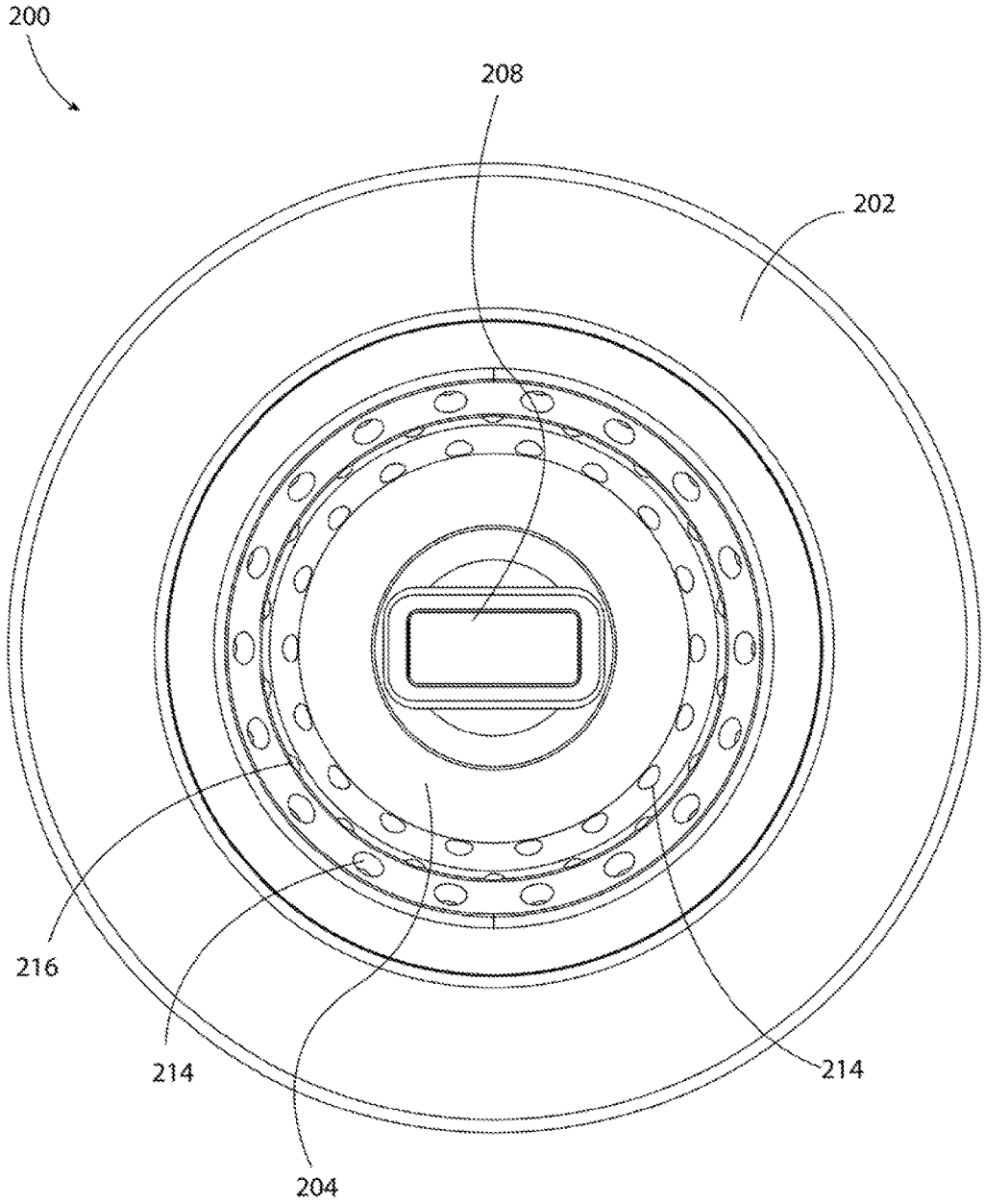
FIG. 13 is a top side view of the drain strainer and stopper illustrated in FIG. 9 in accordance with some embodiments.
Figure 14:
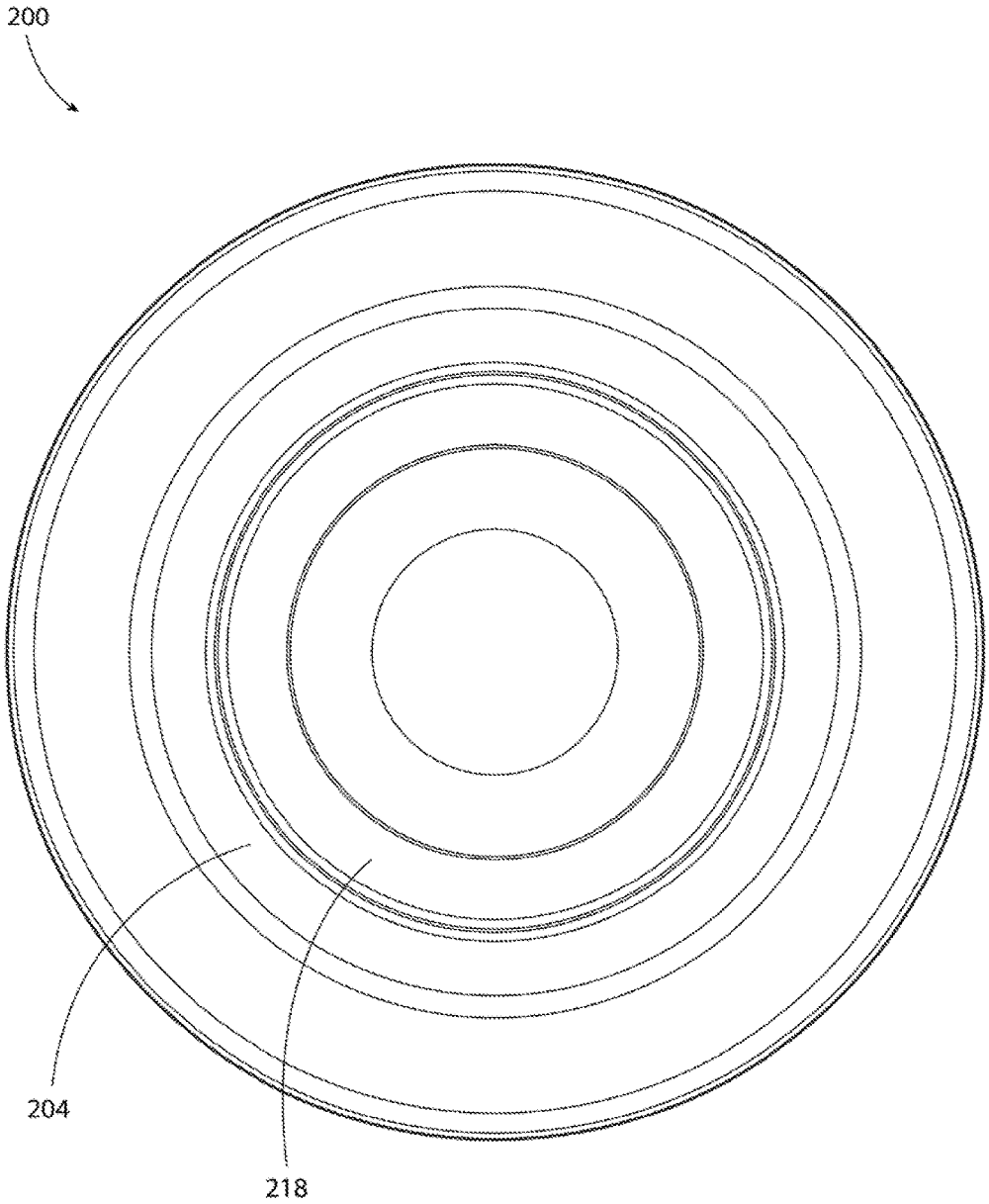
FIG. 14 is a bottom side view of the drain strainer and stopper illustrated in FIG. 9 in accordance with some embodiments.
Figure 15:
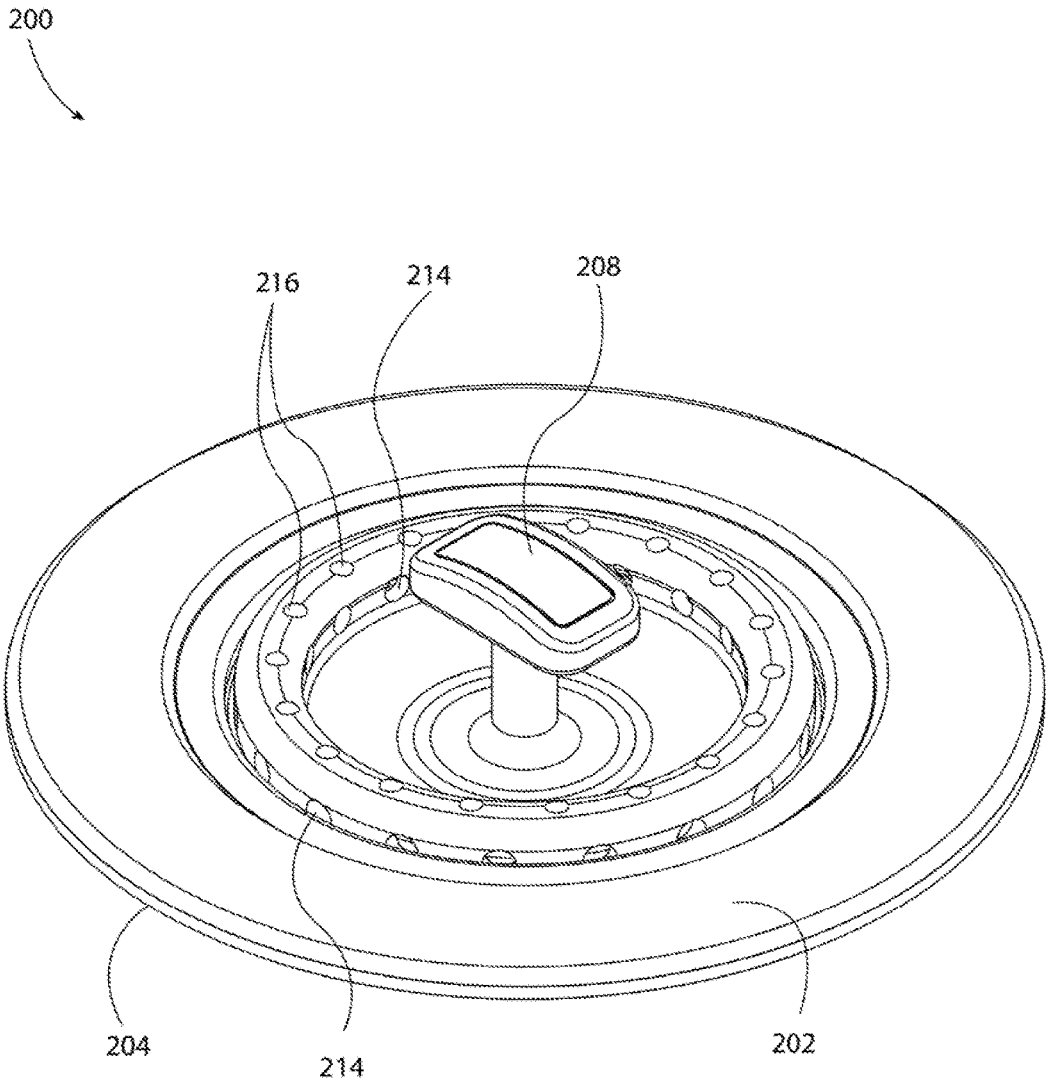
FIG. 15 is in isometric view of the drain strainer and stopper illustrated in FIG. 9 in a collapsed configuration in accordance with some embodiments.
Figure 16:
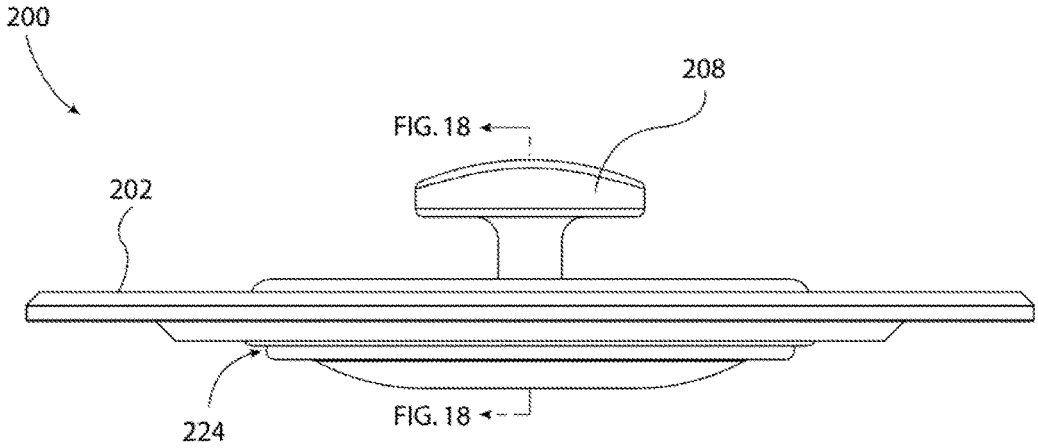
FIG. 16 is a front side view of the drain strainer and stopper illustrated in FIG. 15 in accordance with some embodiments.
Figure 17:
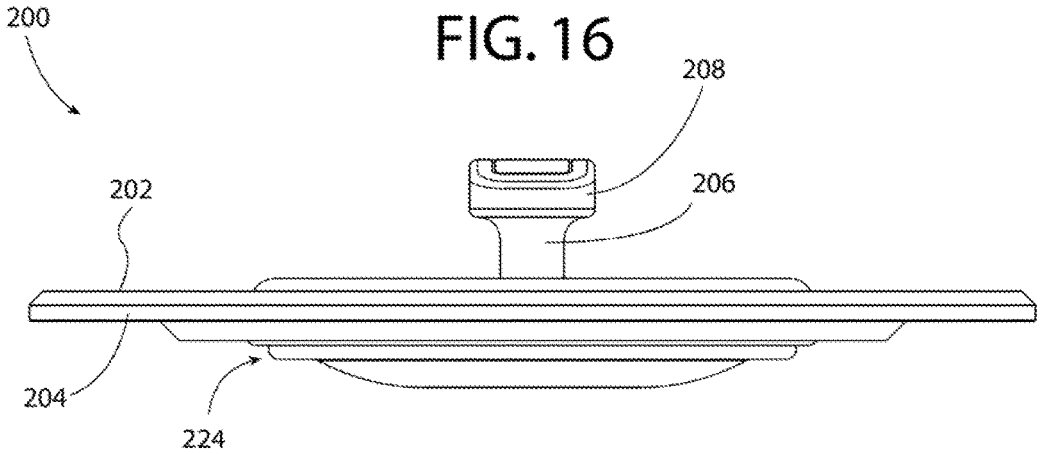
FIG. 17 is a side view of the drain strainer and stopper illustrated in FIG. 15 in accordance with some embodiments.
Figure 18:
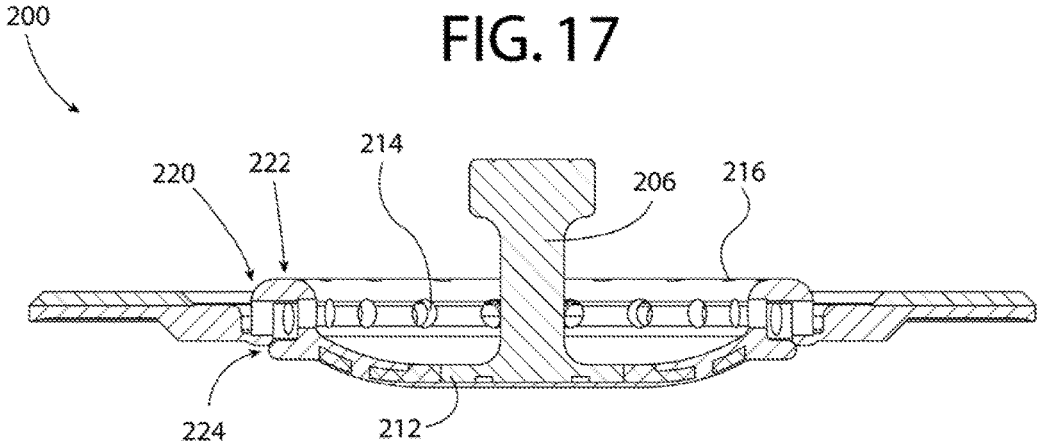
FIG. 18 is a cross-sectional view of the drain strainer and stopper illustrated in FIG. 15 in accordance with some embodiments.

As best seen in FIGS. 9A, 12-13, the diameter of flange 212 of strainer/stopper 200 is greater than the diameter of flange 112 of strainer/stopper 100. The increased diameter of flange 212 assists in transitioning strainer/stopper 200 from an expanded configuration to a collapsed configuration. Additionally, in some embodiments, an additional structure(s) 226 is provided within the lower end 204*b* of body 204 adjacent to flange 212. Structure(s) 226 assists in transitioning strainer/stopper 200 from an expanded configuration to a collapsed configuration and in the creation of a seal 224 between the area of body 204 adjacent to area 220 underside of the upper end 204*a* of body 204 and flange 218. In some embodiments, structures(s) 226 may be a single structure that extends circumferentially within or about body 204 or structure(s) 226 may include a plurality of discrete structures positioned at different circumferential locations within or about body 204. In some embodiments, structure(s) 226 are formed from the same material as stem 206, although a person of ordinary skill in the art will understand that structures(s) 226 may be formed from a material that differs from the material from which stem 206 is formed.

Turning now to FIG. 12, the underside of lateral extension 228 of body 204 includes a protrusion 230 that extends away from base 202 in some embodiments. Protrusion 230 extends away from base 202 and assists in forming a seal between strainer/stopper 200 and the base of a sink (not shown). The method of operation of strainer/stopper 200 is the same as that disclosed above with respect to strainer/stopper 100.

FIGS. 19-22 illustrate another example of a strainer/stopper 300 in accordance with some embodiments. Features of strainer/stopper 300 that are the same or similar to features of strainer/stopper 100 have the same reference numeral increased by 200. Common descriptions are not provided herein.

Figure 19:
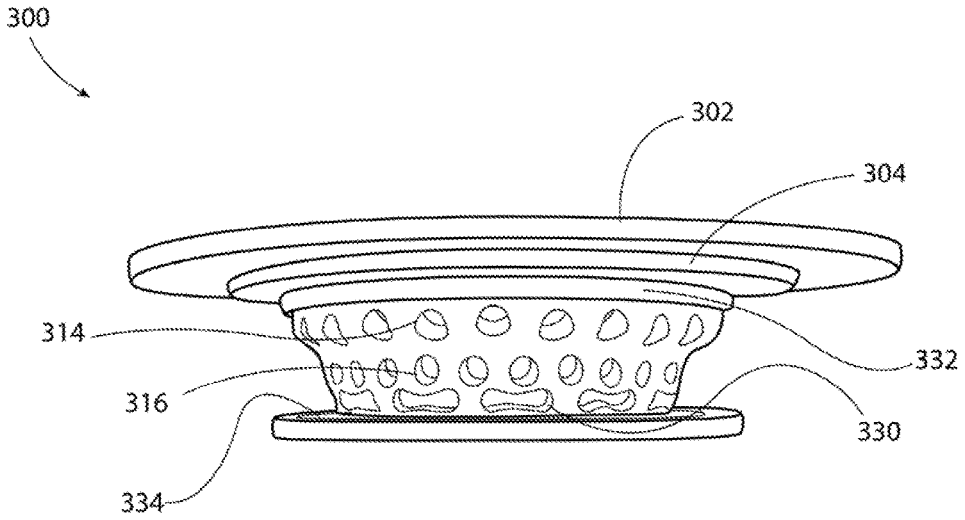
FIG. 19 is an isometric view of a drain strainer and stopper in an extended configuration in accordance with some embodiments.

As best seen in FIG. 19, in some embodiments, the body 304 includes a first set of holes 314, having a first size, a second set of holes 316 having a second size, and a third set of holes 330 having a third size. In some embodiments, the first, second, and third set of holes 314, 316, 330 are disposed in circumferential rows. In the illustrated embodiment, the first, second, and third sets of holes 314, 316, 330 are disposed in circumferential rows with the first set of holes 314 above the second set of holes 316 and the second set of holes 316 above the third set of holes 330. The holes 314, 316, 330 may be circular and/or non-circular openings. For example, in the illustrated embodiment, the third set of holes 330 comprises a non-circular opening having a first circumferential section and a second circumferential section coupled by an elongate section (e.g., bone shaped). The shape of the holes 314, 316, 330 may be configured to provide increased fluid flow when the body 304 is in an extended position and to reduce the necessary force to transition the body 304 to a collapsed position.

Figure 20:
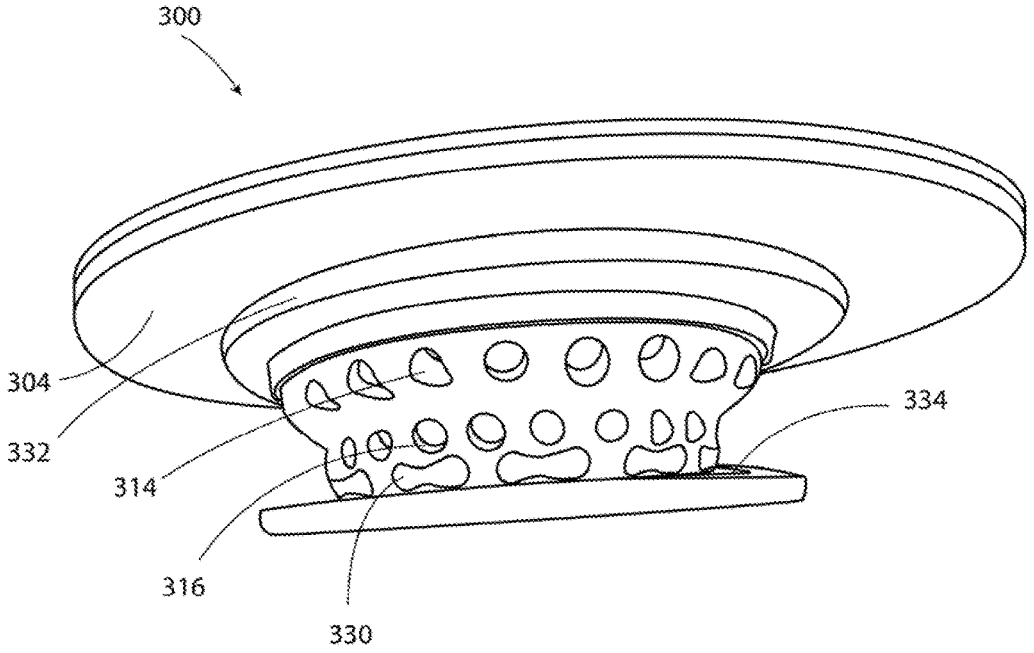
FIG. 20 is a bottom perspective view of the drain strainer and stopper illustrated in FIG. 20 in accordance with some embodiments.
Figure 21:
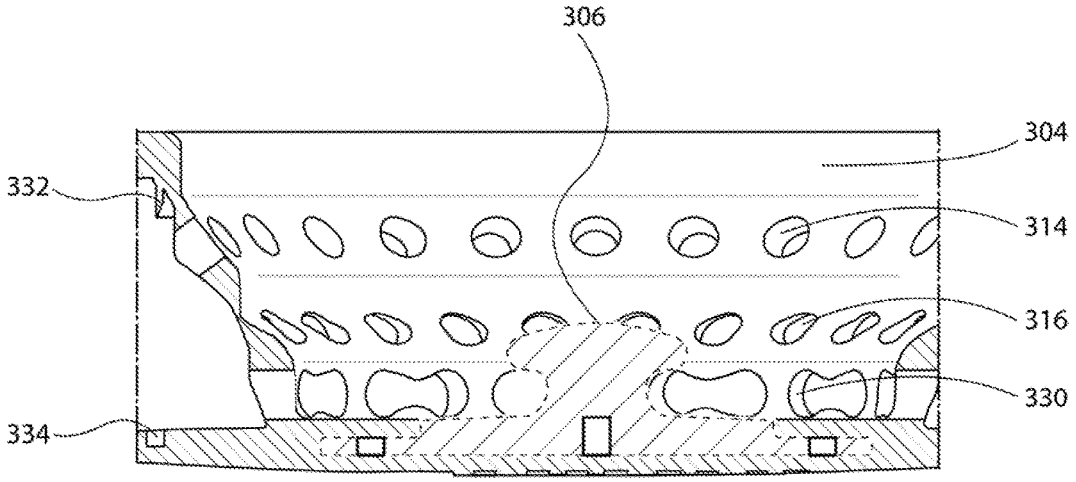
FIG. 21 is a side perspective view of the drain strainer and stopper illustrated in FIG. 20 in accordance with some embodiments.
Figure 22:
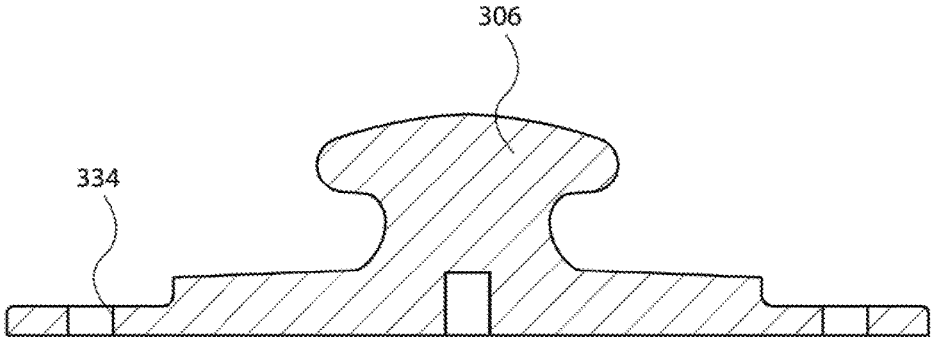
FIG. 22 is a side perspective view of a stem of the drain strainer and stopper illustrated in FIGS. 19-21.

As best seen in FIGS. 20-21, in some embodiments, a circumferential ring 332 (or rib) is disposed about an upper portion of the body 304. The circumferential ring 332 may be coupled to the base 302 and/or the body 304. The circumferential ring 332 extends over a portion of the body 304 and may be in contact with and/or spaced apart from the body 304. A complementary circumferential channel 334 is defined by the flange 312. In some embodiments, the circumferential channel 334 is sized and configured to receive the circumferential ring 332 therein such that at least a portion of circumferential ring 332 contacts and seals against a wall defining channel 334 while the rest of flange 312 contacts the body 304 to provide a further seal. For example, in some embodiments, a lower-most portion of circumferential ring 332 contacts the bottom wall defining channel 334. One of ordinary skill in the art will understand that, in some embodiments, the circumferential ring 332 has a complementary geometry to channel 334 such that a ring 332 fills and contacts the walls defining channel 334 to provide a seal. In some embodiments, the diameter of flange 312 of strainer/stopper 300 is greater than the diameter of flange 112 of strainer/stopper 100 and/or the flange 212 of strainer/stopper 200 such that the flange contacts and seals against the body 304.

When the body 304 is transitioned to a second collapsed position (see for example, FIGS. 23-24), the circumferential ring 332 is positioned within the circumferential channel 334 to further seal the strainer/stopper 300 when in a collapsed position. In some embodiments, the interface between the circumferential ring 332 and the circumferential channel 334 provides a water tight seal when the body 304 is in the second collapsed position. The circumferential ring 332 may comprise any suitable material, such as, for example, stainless steel, aluminum, polymers, plastics, silicone and/or a flexible plastic or polymer, to list only a few possible materials.

In various embodiments, an apparatus comprising a base defining an opening and being formed from a first material and a body coupled to the base and formed from a second material is disclosed. The body defines a plurality of holes and includes an outwardly extending flange. The body is configured to be positioned in an extended configuration and a collapsed configuration. The flange forms a fluid-tight seal with a portion of the body in the collapsed configuration.

Figure 23:
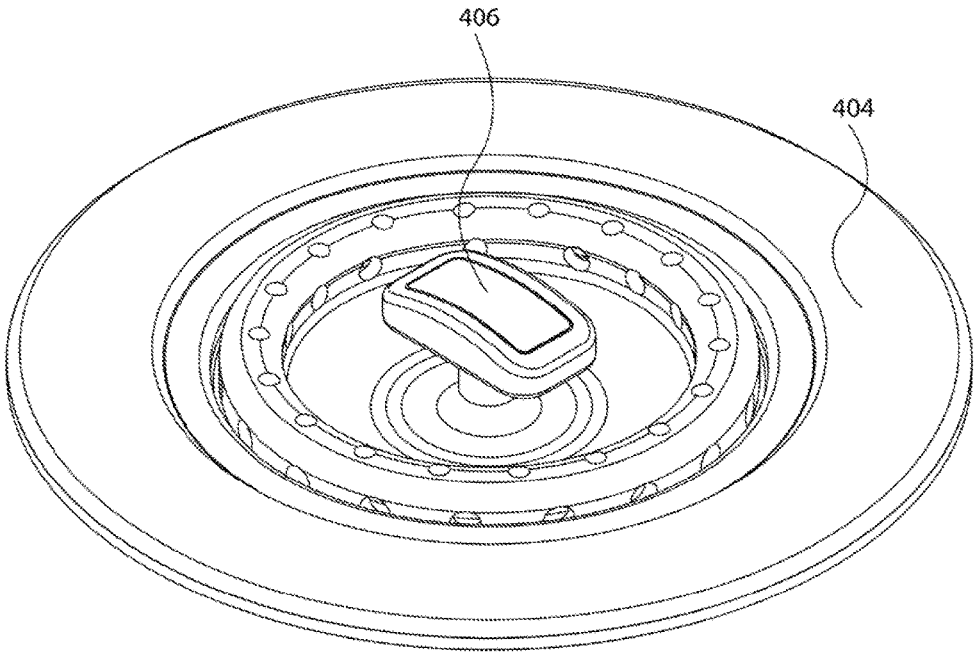
FIG. 23 is an isometric view of a drain strainer and stopper illustrated in accordance with some embodiments.
Figure 24:
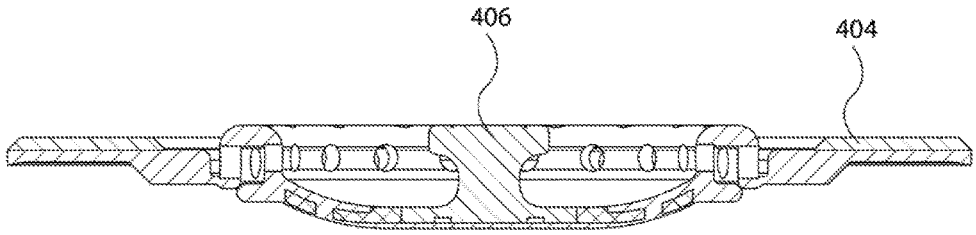
FIG. 24 is a side view of the drain strainer and stopper of FIG. 23 in accordance with some embodiments.
Figure 25:
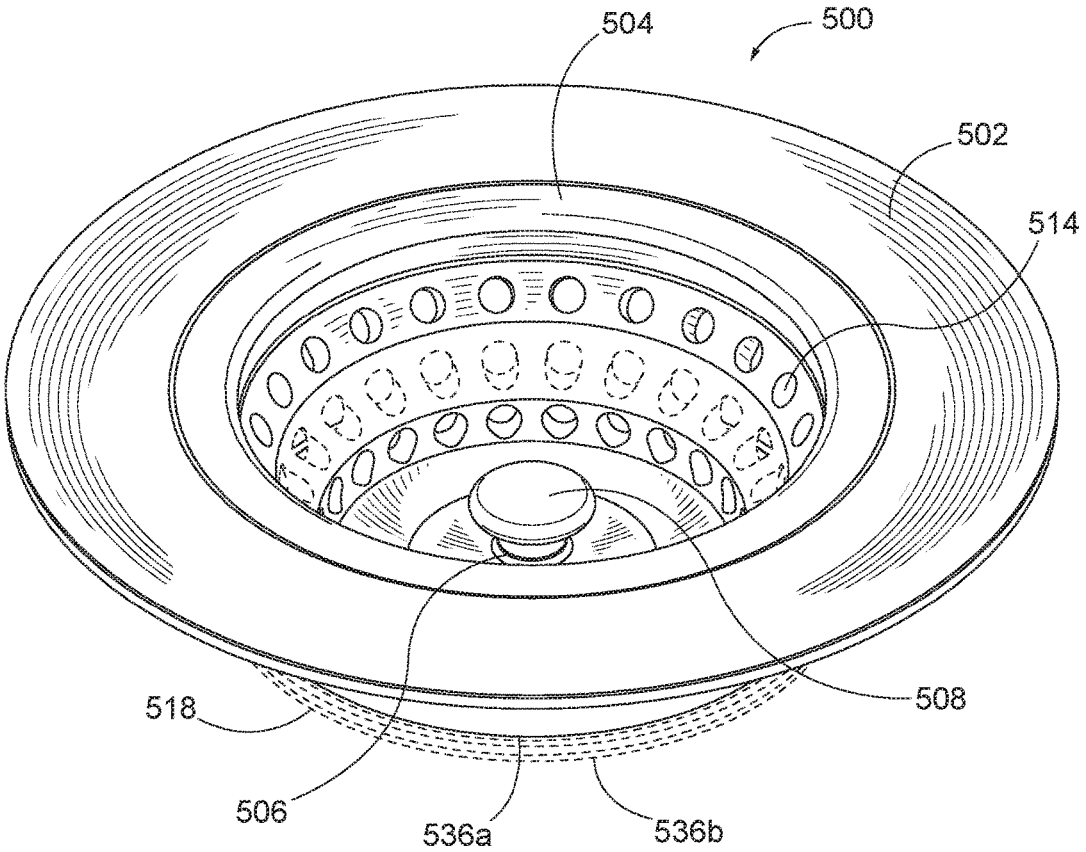
FIG. 25 is a top isometric view of a drain strainer and stopper illustrated in accordance with some embodiments of one embodiment.
Figure 26:
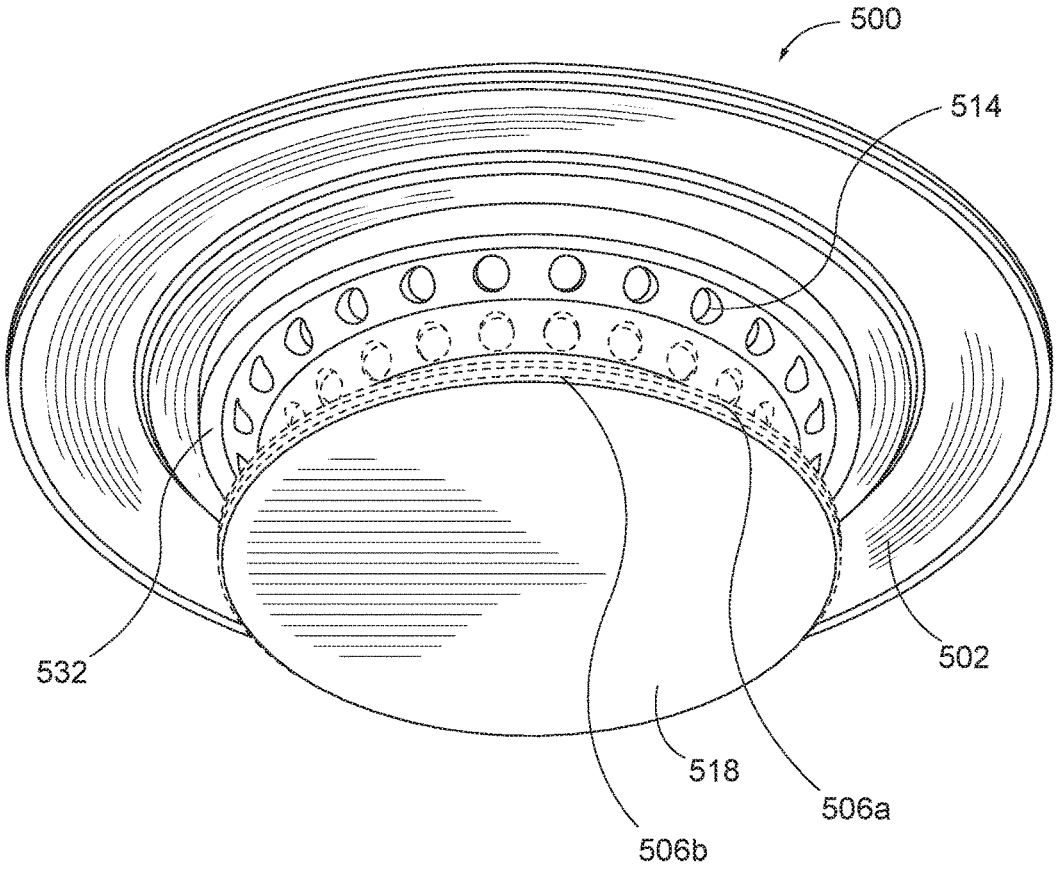
FIG. 26 is a bottom isometric view of the drain strainer and stopper of FIG. 25, in accordance with some embodiments.
Figure 27:
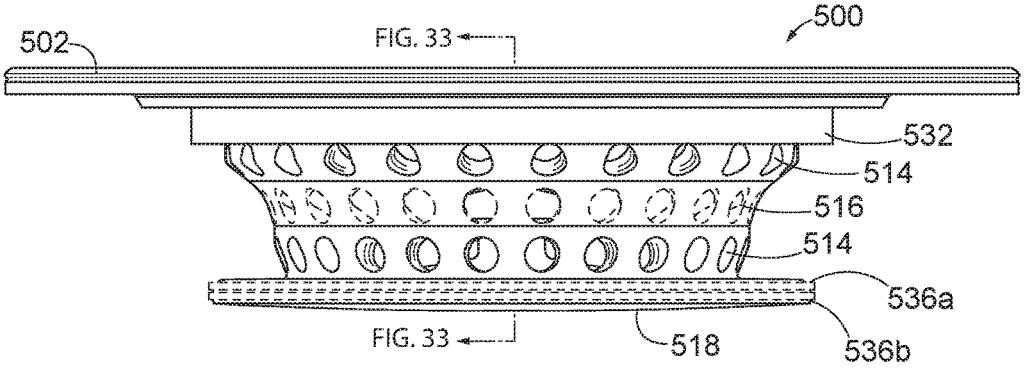
FIG. 27 is a front elevation view of the sink strainer and stopper in the open state, in accordance with some embodiments.
Figure 28:
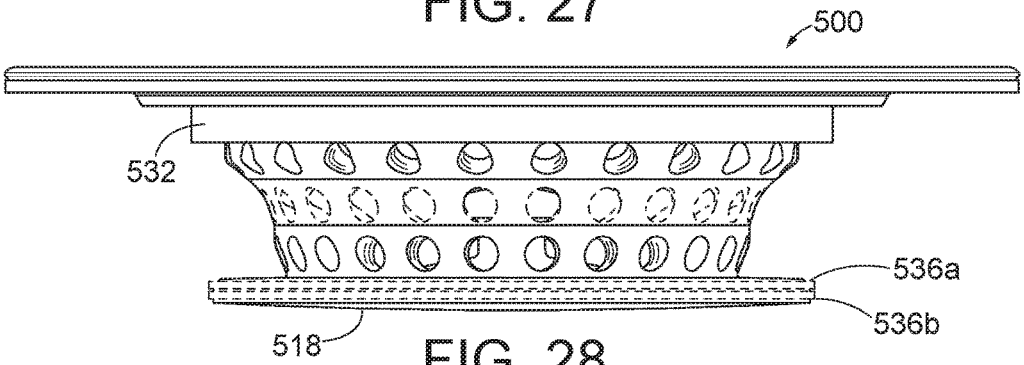
FIG. 28 is a rear elevation view of the sink strainer and stopper in the open state, in accordance with some embodiments.
Figure 29:
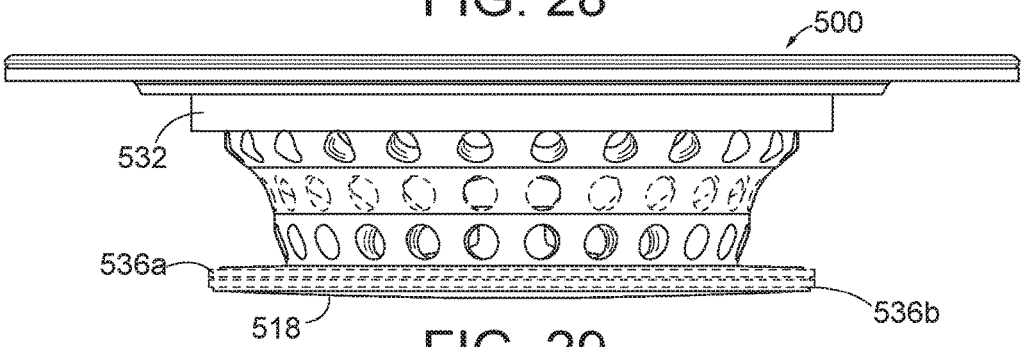
FIG. 29 is a side elevation view of the sink strainer and stopper in the open state, in accordance with some embodiments.
Figure 30:
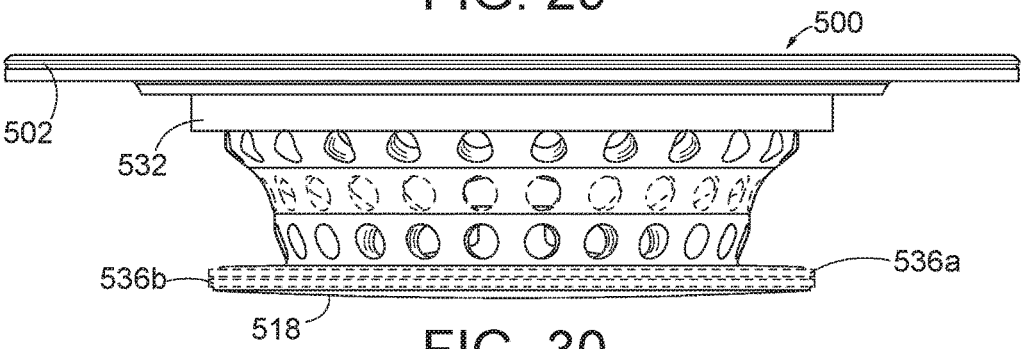
FIG. 30 is a side elevation view of the sink strainer and stopper opposite the view in FIG. 5 in the open state, in accordance with some embodiments.
Figure 31:
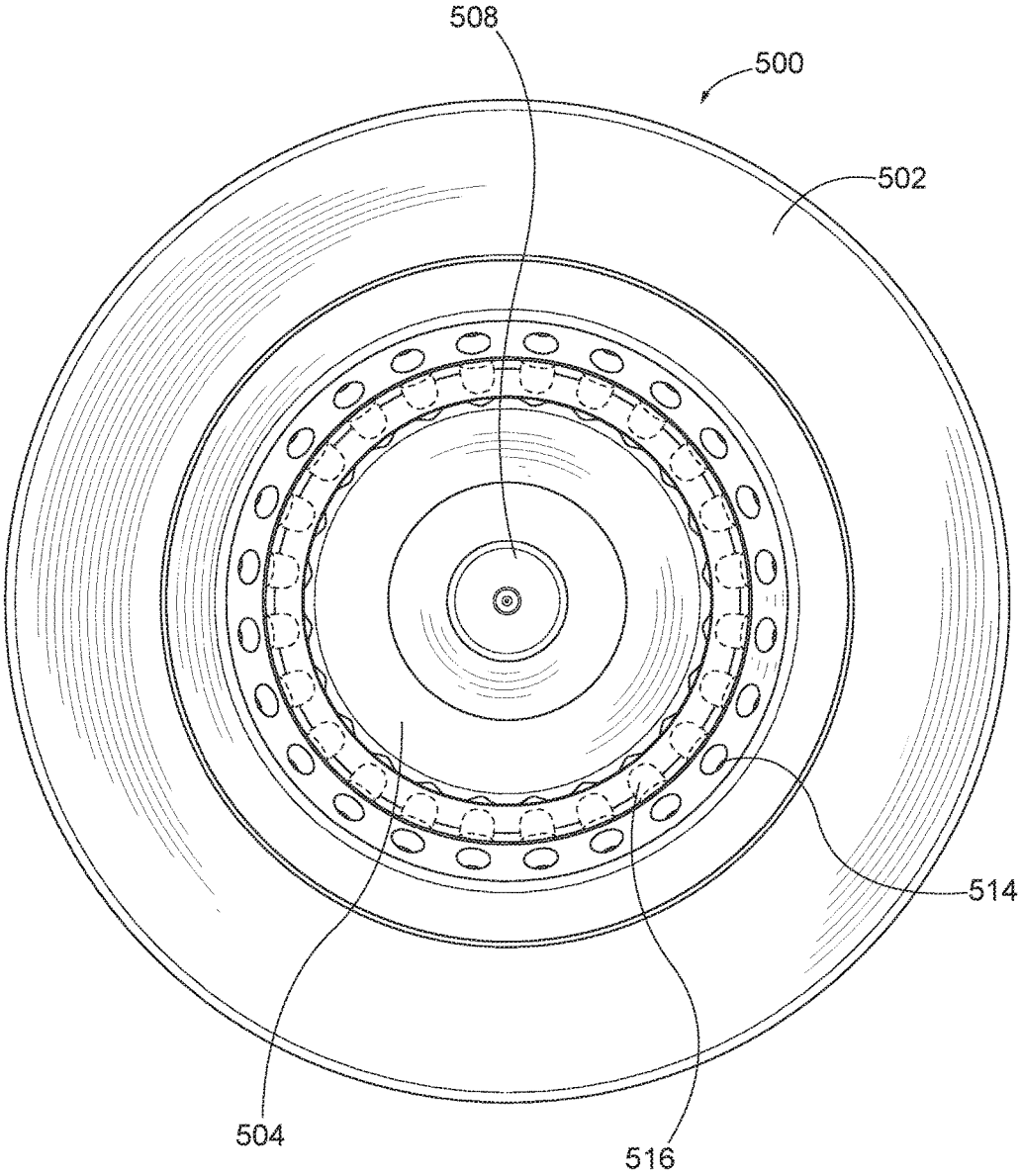
FIG. 31 is a top side view of the sink strainer and stopper in the open state, in accordance with some embodiments.
Figure 32:
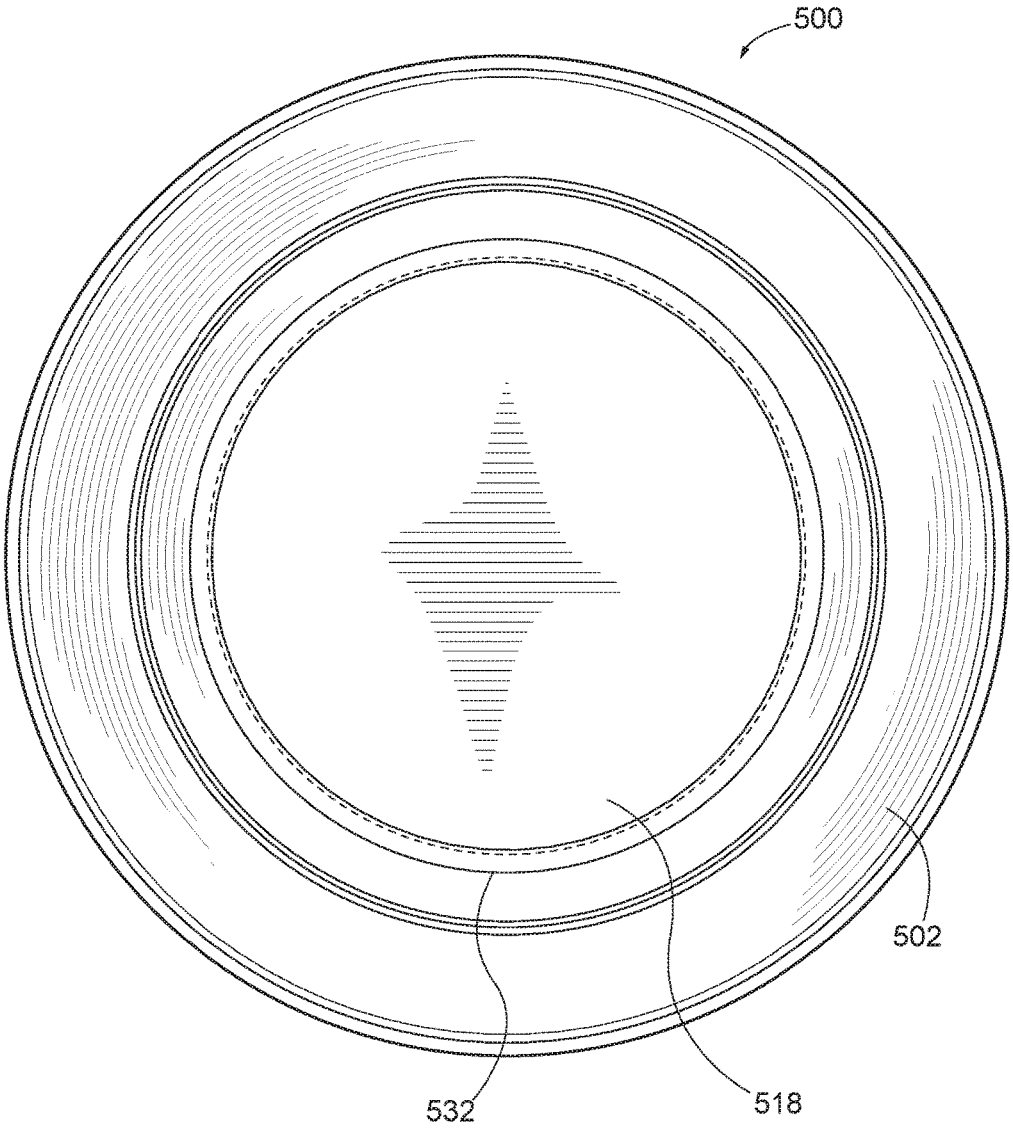
FIG. 32 is a bottom side view of the sink strainer and stopper in the open state, in accordance with some embodiments.
Figure 33:
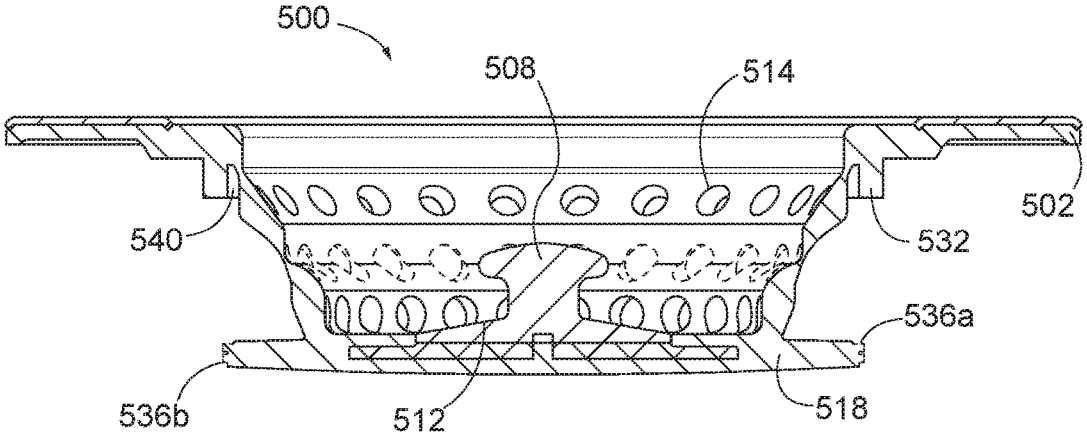
FIG. 33 is a cross-sectional view of the sink strainer and stopper in the open state taken along line FIG. 33-FIG. 33 in FIG. 27, in accordance with some embodiments.
Figure 34:
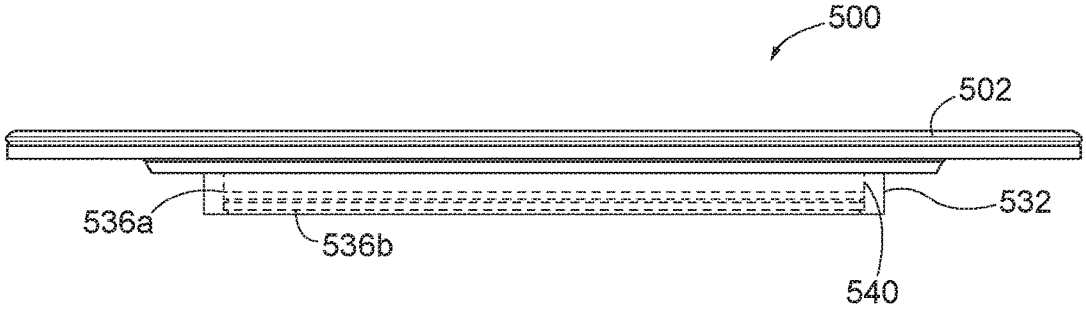
FIG. 34 is a front side view of the sink strainer and stopper in a closed state, in accordance with some embodiments.

FIGS. 23-24 illustrate one embodiment of a strainer/stopper 400. Features of strainer/stopper 400 that are the same or similar to features of strainer/stopper 300 have the same reference numeral increased by 100. Common descriptions are not provided herein.

As shown in FIGS. 23-24, when the strainer/stopper 400 is in a collapsed position, the body 404 folds about circumferential axis such that strainer/stopper 400 functions as a drain stopper in which fluid cannot pass from the upper side of the stopper 400 to the lower side of the stopper 400. When body 404 folds onto itself, the top of the stem 406 is flush with a top surface of the body 404. For example, as shown in FIG. 24, when the strainer/stopper 400 is in the collapsed position, the top of the stem 406 and the body 404 are flush. In some embodiments, the top of the stem 406 may be recessed beneath the top surface of the body 404. Although an elongated stem 406 is illustrate, it will be appreciated that the stem 406 may have any suitable shape, such as, for example, a rounded shape, a square shape, and/or any other suitable geometric shape.

FIGS. 25-34 illustrate one embodiment of a strainer/stopper 500. Features of the strainer/stopper 500 that are the same or similar to features of strainer/stopper 400 have the same reference numeral increased by 100. Common descriptions are not provided herein.

As shown in FIGS. 25-34, in some embodiments, the strainer/stopper 500 includes a flange 518 having at least one rib 536*a*. 536*b* extending therefrom. The at least one rib 536*a*, 536*b* is sized and configured to be received within a circumferential ring 532 disposed about an upper portion 504 of the strainer/stopper 500. The circumferential ring 532 has an internal diameter sized and configured to receive the flange 512 and the ribs 536*a*, 536*b* therein. When the flange 518 is positioned within the circumferential ring 532, the ribs 536*a*, 536*b* form a fluid-tight seal with the inner surface 540 of the circumferential ring. In some embodiments, the flange 518 has a circumference less than the internal circumference of the circumferential ring 532 and the ribs 536*a*, 536*b* have a circumference equal to and/or slightly greater than the internal circumference of the circumferential ring 532. In some embodiments the ribs 536*a*, 536*b* are deflected out of a plane of the flange 512 when received within the circumferential ring 532.

In some embodiments, when the body 504 is transitioned from the first expanded position to a second collapsed position (see for example, FIG. 34), the ribs 536*a*, 536*b* are positioned within the circumferential ring 532 to further seal the strainer/stopper 500 when in a collapsed position. The circumferential ring 532 can comprise any suitable material, such as, for example, stainless steel, aluminum, polymers, plastics, silicone and/or a flexible plastic or polymer, to list only a few possible materials. In some embodiments, the flange 518 and/or the ribs 536*a*, 536*b* can comprise any suitable material, such as, for example, stainless steel, aluminum, polymers, plastics, silicone and/or a flexible plastic or polymer, to list only a few possible materials.

In some embodiments, the circumferential ribs 536*a*, 536*b* provide a friction fit within the inner diameter of the circumferential ring 532. The rings 536*a*, 536*b* can be forced slightly out-of-plane with respect to the flange 518 when received within the circumferential ring 532. The friction fit between the ribs 536*a*, 536*b* and the circumferential ring 532 provides a fluid-tight seal. In some embodiments, the inner surface 540 of the circumferential ring 532 can comprise one or more channels (not shown) sized and configured to receive the ribs 536*a*, 536*b* therein.

In various embodiments, a drain strainer and stopper is disclosed. The drain strainer and stopper includes a base defining an opening. A body is coupled to the base. The body defines a plurality of holes and includes a circumferential ring coupled to a first side of the body. The body further includes an outwardly extending flange sized and configured to be received within the circumferential ring. The body is configured to be positioned in an extended configuration and a collapsed configuration. The flange includes at least one outwardly extending circumferential rib that forms a fluid-tight seal with an inner surface 540 of the circumferential ring in the collapsed configuration.

In various embodiments, a method of operating a strainer and stopper is disclosed. The method comprises placing an outer surface of a body of a strainer and stopper in contact with a surface of a sink such that the body of the drain strainer and stopper is at least partially aligned with a drain of the sink and transitioning the body of the strainer and stopper to one of a collapsed configuration and an extended configuration. In the collapsed configuration, at least one circumferential rib extending from a flange of the strainer and stopper forms a fluid tight seal with an inner surface of a circumferential ring coupled to a body of the strainer and stopper. In the extended configuration, fluid is able to pass through a plurality of holes defined by the body.

In various embodiments, a drain strainer and stopper is disclosed. The drain strainer and stopper includes a base defining an opening. The base is formed from a first material. A body is coupled to the base and formed from a second material. The body defines a plurality of holes and includes a circumferential ring coupled to a first side of the body. The body further includes an outwardly extending flange sized and configured to be received within the circumferential ring. The body is configured to be positioned in an extended configuration and a collapsed configuration. The flange includes at least one outwardly extending circumferential rib that forms a fluid-tight seal with an inner surface of the circumferential ring in the collapsed configuration. The body includes at least one area having a reduced thickness to facilitate transitioning from the first extended configuration to the second collapsed configuration.

Although the apparatus and method have been described in terms of exemplary embodiments, they are not limited thereto. Rather, the appended claims should be construed broadly, to include other variants and embodiments of the apparatus and method, which may be made by those skilled in the art without departing from the scope and range of equivalents of the apparatus and method.

What is claimed is:

1. An apparatus, comprising:

a base defining an opening; and a body coupled to the base, the body defining a plurality of holes, wherein the body includes a circumferential ring coupled to a first side of the body and an outwardly extending flange sized and configured to be received within the circumferential ring, wherein the body is configured to be positioned in an extended configuration and a collapsed configuration, wherein the flange includes at least one outwardly extending circumferential rib, and wherein the at least one rib forms a fluid-tight seal with an inner surface of the circumferential ring in the collapsed configuration.

2. The apparatus of claim 1, wherein the body includes at least one area having a reduced thickness to facilitate transitioning from the first extended configuration to the second collapsed configuration.

3. The apparatus of claim 2, wherein the body is configured to fold at the least one area having the reduced thickness when in the second collapsed configuration.

4. The apparatus of claim 1, further comprising a stem extending from a bottom inner surface of the body.

5. The apparatus of claim 4, wherein the stem includes a knob at an upper end of the stem.

6. The apparatus of claim 5, wherein the stem is coupled to the flange.

7. The apparatus of claim 1, wherein the body defines a first set of holes having a first size and disposed in a first circumferential row, a second set of holes having a second size and disposed in a second circumferential row, and a third set of holes having a third size and disposed in a third circumferential row.

8. The apparatus of claim 7, wherein the first and second sizes are equal to one another but different from the second size, and wherein the second set of holes is positioned between the first set of holes and the third set of holes.

9. The apparatus of claim 7, wherein the first, second, and third sizes are different, and wherein the first set of holes is positioned above the second set of holes and the second set of holes is positioned above the third set of holes.

10. The apparatus of claim 9, wherein the third set of holes comprises a first circumferential section and a second circumferential section coupled by an elongated section.

11. The apparatus of claim 7, wherein the flange is configured to seal the first set of holes, the second set of holes, and the third set of holes in the second collapsed configuration.

12. The apparatus of claim 1, comprising a first circumferential rib and a second circumferential rib extending from the flange, and wherein the flange has a circumference less than the circumference of the circumferential ring, and wherein the first and second circumferential ribs form a fluid tight seal with the inner surface of the circumferential ring.

13. The apparatus of claim 12, wherein each of the first and second circumferential ribs are deflected partially out of plane when received within the inner surface of the circumferential ring.

14. The apparatus of claim 1, wherein the base is formed from a first material and the body is formed from a second material.

15. A method, comprising placing an outer surface of a body of a strainer and stopper in contact with a surface of a sink such that the body of the drain strainer and stopper is at least partially aligned with a drain of the sink; and transitioning the body of the strainer and stopper to one of a collapsed configuration and an extended configuration, wherein in the collapsed configuration, at least one circumferential rib extending from a flange of the strainer and stopper forms a fluid tight seal with an inner surface of a circumferential ring coupled to a body of the strainer and stopper, and in the extended configuration, fluid is able to pass through a plurality of holes defined by the body.

16. The method of claim 15, wherein transitioning the body from the extended configuration to the collapsed configuration comprises applying a force to the body to translate the body towards a base that is coupled to the body.

17. The method of claim 16, wherein the force is applied to the body by a stem coupled to the body.

18. The method of claim 16, wherein the at least one rib is deflected out of a plane of the flange when received within the circumferential ring.

19. The method of claim 15, wherein transitioning the body from the collapsed configuration to the extended configuration includes applying a force to the body to translate the body away from a base to which the body is coupled.

20. The method of claim 15, wherein the plurality of holes comprises a first circumferentially aligned set of holes and a second circumferentially aligned set of holes, and wherein at least one of the first circumferentially aligned set of holes or the second circumferentially aligned set of holes is configured to reduce the force required to transition the body from the extended position to the collapsed position.

21. A drain strainer and stopper, comprising:

a base defining an opening and being formed from a first material, wherein the base has a diameter greater than the diameter of the drain opening; and a body coupled to the base and formed from a second material, the body defining a plurality of holes, wherein the body includes a circumferential ring coupled to a first side of the body and an outwardly extending flange sized and configured to be received within the circumferential ring;

wherein the body is configured to be positioned in an extended configuration and a collapsed configuration, wherein the flange includes at least one outwardly extending circumferential rib, and wherein the at least one rib forms a fluid-tight seal with an inner surface of the circumferential ring in the collapsed configuration, and wherein the body includes at least one area having a reduced thickness to facilitate transitioning from the first extended configuration to the second collapsed configuration.

* * * * *